US005754216A

United States Patent [19]

Higuchi et al.

[11] Patent Number: 5,754,216

[45] Date of Patent: May 19, 1998

[54] OPTICAL RECORDING HEAD AND IMAGE RECORDING APPARATUS

[75] Inventors: Kazuhiko Higuchi, Kawasaki; Eiichi Sakaue, Urayasu, both of Japan

[73] Assignee: Kabushiki Kaisha Toshiba, Kawasaki, Japan

[21] Appl. No.: 308,499

[22] Filed: Sep. 21, 1994

[30] Foreign Application Priority Data

Sep. 22, 1993 [JP] Japan ..... 5-236960
Aug. 30, 1994 [JP] Japan ..... 6-205516

[51] Int. Cl.[6] ..... B41J 2/415; B41J 2/45

[52] U.S. Cl. ..... 347/238; 347/122

[58] Field of Search ..... 347/238, 59, 122, 347/132; 355/237

[56] References Cited

U.S. PATENT DOCUMENTS

| | | | |
|---|---|---|---|
| 4,859,913 | 8/1989 | Genovese et al. | 347/122 |
| 4,949,101 | 8/1990 | Shimizu | 347/122 |
| 5,402,157 | 3/1995 | Nagato et al. | 347/122 |

FOREIGN PATENT DOCUMENTS

| | | |
|---|---|---|
| 61-203555 | 9/1961 | Japan . |
| 63-6981 | 2/1988 | Japan . |
| 3-22021 | 3/1991 | Japan . |
| 569588 A | 3/1993 | Japan . |

*Primary Examiner*—Benjamin R. Fuller
*Assistant Examiner*—Thinh Nguyen
*Attorney, Agent, or Firm*—Finnegan, Henderson, Farabow, Garrett & Dunner, L.L.P.

[57] ABSTRACT

An optical recording head comprises a cathode for emitting electrons, and an emission element array, provided apart from the cathode. The emission element array has a substrate, a plurality of anodes arranged at predetermined intervals on the substrate, a plurality of phosphor cells, arranged in contact to the anodes on the substrate, for emitting light based on the electrons from the cathode, and an insulation layer formed on the substrate, and a control electrode, laid out on the insulation layer while being electrically insulated from the anodes, in such a way as to surround the phosphor cells. The control electrode accelerates the electrons from the cathode.

24 Claims, 19 Drawing Sheets

FIG. 17A
FIG. 17B
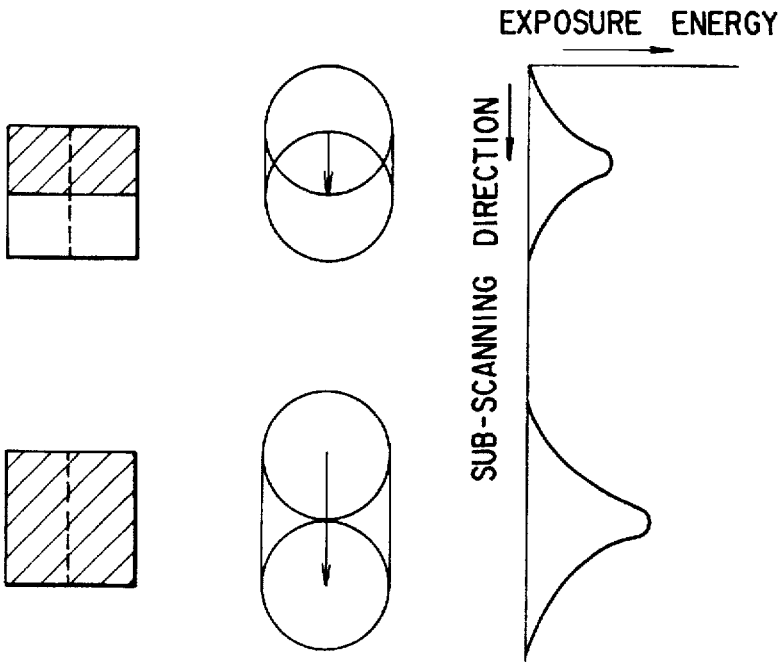
FIG. 18A
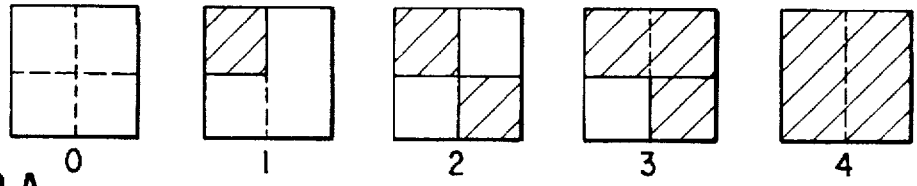
FIG. 18B
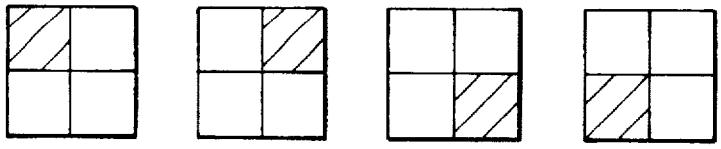
FIG. 18C
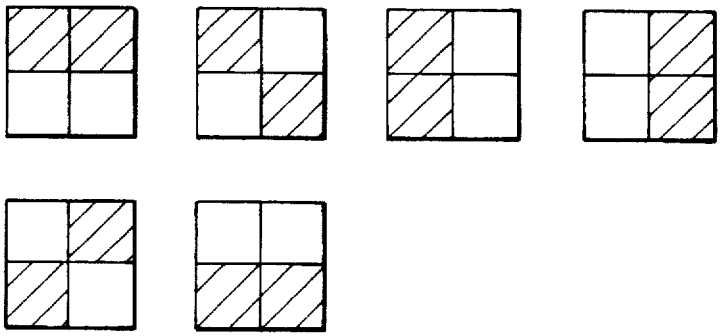
FIG. 18D
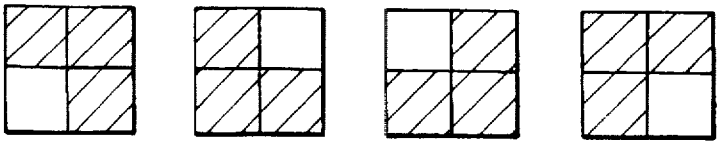

| | | |
|---|---|---|
| 1 | 2 | 3 |
| 2561 | 2562 | 2563 |
| 5121 | 5122 | 5123 |

FIG. 24A

| | | | | | |
|---|---|---|---|---|---|
| l1 | r1 | l2 | r2 | l3 | r3 |
| L1 | R1 | L2 | R2 | L3 | R3 |
| l2561 | r2561 | l2562 | r2562 | l2563 | r2563 |
| L2561 | R2561 | L2562 | R2562 | L2563 | R2563 |
| l5121 | r5121 | l5122 | r5122 | l5123 | r5123 |
| L5121 | R5121 | L5122 | R5122 | L5123 | R5123 |

FIG. 24B

| SL | DATA | DATA 1 | DATA 2 |
|---|---|---|---|
| 0 | 0 | 0 | 0 |
| 0 | 1 | 1 | 0 |
| 0 | 2 | 1 | 0 |
| 0 | 3 | 1 | 1 |
| 0 | 4 | 1 | 1 |
| 1 | 0 | 0 | 0 |
| 1 | 1 | 0 | 0 |
| 1 | 2 | 0 | 1 |
| 1 | 3 | 0 | 1 |
| 1 | 4 | 1 | 1 |

FIG. 25A

| | |
|---|---|
| 0 | 2 |
| 3 | 1 |

FIG. 25B

OPTICAL RECORDING HEAD AND IMAGE RECORDING APPARATUS

BACKGROUND OF THE INVENTION

1. Field of the Invention

The present invention relates to an optical recording head which utilizes light emission from phosphor cells, and an image recording apparatus like an electrophotographic printer, which records images using the optical recording head.

2. Description of the Related Art

An optical recording head, which obtains desired emission pixels by controlling the light emission from phosphor cells, is known as an optical recording head of a solid scanning type, which is used in an optical recording apparatus like an electrophotographic printer.

For example, Jap. Pat. Appln. KOKOKU Publication No. 3-22021 discloses an optical recording head, which has anodes and phosphor cells provided on the substrate and a grid arranged above them to control the light emission of the phosphor cells.

Because of its so-called triode valve structure where the grid is laid in the space between the filament cathode and phosphor cells, this optical recording head has an excellent light emission controllability. It is however necessary to stably support the grid while keeping the accurate relative positional relation with the cathode and the phosphor cells, resulting in a higher manufacturing cost.

Further, since the phosphor cells of the optical recording head are generally prepared by the thick film printing technology such as screen printing, it is difficult to make the pixels formed by the phosphor cells to a fine size of, for example, 10 μm or smaller. This stands in the way of providing high resolution.

As one conventional scheme of recording tone images with the optical recording head, a dither method and density patterning are known which express one tone level by a combination of a plurality of pixels. With the combination of the conventional optical recording head and tone expressing method, however, there is a tradeoff between the number of expressible tones and the resolution. For instance, obtaining a multi-tone image requires an increase in the number of pixels (the size of the dither matrix in the case of the dither method) used to express the tone, thus reducing the resolution. In other words, to improve the resolution while ensuring multi-tones, it is necessary to make the emission pixels of the optical recording head smaller to enhance the layout density. This requires an improved technology to manufacture the optical recording head, thus increasing the manufacturing cost.

According to the optical recording head which utilizes the light emission of the phosphor cells, as mentioned above, it is difficult to design the pixels, formed by the phosphor cells, to a fine size, thus making it difficult to improve the resolution. Further, with the combination of the conventional optical recording head and tone expressing method, such as the dither method or density patterning method, the improvement on the resolution while satisfying multi-tones requires that the layout density of the emission pixels of the optical recording head should be enhanced. This requires an improved technology to manufacture the optical recording head and thus increases the manufacturing cost.

SUMMARY OF THE INVENTION

Accordingly, it is an object of the present invention to provide an optical recording head with a simple structure, which obtains desired emission pixels by controlling the light emission of phosphor members and has a simple structure and can be manufactured at a low cost.

It is another object of this invention to provide an optical recording head, which has emission pixels that uses the light emission of phosphor members and can record an image with a resolution higher than the layout density of the emission pixels.

It is a further object of this invention to provide an image recording apparatus capable of recording a multi-tone and high-resolution image using an optical recording head which has an emission element array.

An optical recording head according to the first aspect of this invention is characterized by comprising: a cathode for emitting electrons; and an emission element array, provided apart from the cathode and having a substrate, a plurality of anodes arranged at predetermined intervals on the substrate, a plurality of phosphor cells, arranged in contact to the anodes on the substrate, for emitting light based on the electrons from the cathode, and at least one control electrode, laid out so as to surround each of the phosphor cells, for accelerating the electrons from the cathode. The control electrode serves as a grid for accelerating electrons emitted from the cathode to the phosphor cells.

The following are desirable modes of the optical recording head according to the first aspect.

(1) The optical recording head further comprises an insulation layer provided between the anodes and the control electrode; and the control electrode is laid out on the substrate in such a way as to partially overlap the anodes via the insulation layer.

(2) The anodes each have a rectangular opening to set a radiation plane of light emitted from the phosphor cells to a predetermined shape.

(3) The insulation layer has an opening to set an incident plane of the electrons to the phosphor cells to a predetermined shape. That is, the emission pixel area of the phosphor cell is defined by this opening.

(4) The optical recording head further comprises a second insulation layer provided on the insulation layer between adjacent phosphor cells, whereby the control electrode between adjacent phosphor cells is higher than the control electrode in other areas.

(5) The optical recording head further comprises an electrode formed on the control electrode between adjacent phosphor cells.

(6) The control electrode includes: a first control electrode to which a first voltage for forming a predetermined electric field is applied; and a second control electrode provided between adjacent phosphor cells via an insulation layer.

(7) The optical recording head further comprises means for applying a voltage higher than the first voltage to the second control electrode.

(8) The control electrode includes a plurality of control electrodes each laid out to surround an associated one of the phosphor cells.

Another optical recording head according to the first aspect of this invention is characterized by comprising: a cathode for emitting electrons; and an emission element array, provided apart from the cathode and having a substrate, a plurality of anodes arranged at predetermined intervals on the substrate, a plurality of phosphor cells, arranged in contact to the anodes on the substrate, for emitting light based on the electrons from the cathode, an insulation layer formed on the substrate, a first control electrode, provided on the insulation layer and being electrically insulated from the anodes, for accelerating the electrons emitted from the cathode, and a second control electrode for setting an electric field between the phosphor cells stronger than an electric field formed by the first control electrode.

This optical recording head further comprises means for applying a predetermined first voltage to the first control electrode; and means for applying a second voltage higher than the first voltage to the second control electrode.

A further optical recording head according to the first aspect of this invention is characterized by comprising: a cathode for emitting electrons; an emission element array, provided apart from the cathode and having a substrate, a plurality of anodes arranged at predetermined intervals on the substrate, a plurality of phosphor cells, arranged in contact to the anodes on the substrate, for emitting light based on the electrons from the cathode, and a plurality of control electrodes, arranged around each of the phosphor cells, for accelerating the electrons from the cathode; anode driving means for individually driving the plurality of anodes; and control electrode driving means for individual driving the plurality of control electrodes.

The following are desirable modes of this optical recording head.

(1) The control electrodes are arranged so as to surround each of the phosphor cells.

(2) The control electrodes are equal to or less in number than the anodes.

(3) The anode driving means includes means for applying a first voltage to the anodes corresponding to phosphor cells to emit light, the first voltage being positive with respect to a voltage applied to the cathode, and the control electrode driving means includes means for applying a voltage equal to or lower than the first voltage to the control electrodes corresponding to the phosphor cells to emit light; and the control electrode driving means includes means for applying a second voltage to the control electrode corresponding to phosphor cells that are not to emit light, the second voltage being positive with respect to a voltage applied to the cathode, and the anode driving means includes means for applying a voltage equal to or lower than the second voltage to the anodes corresponding to the phosphor cells that are not to emit light.

(4) The control electrode driving means includes means for setting a voltage of the control electrodes corresponding to the phosphor cells that are to emit light to zero, and the anode driving means includes means for setting a voltage of the anodes corresponding to the phosphor cells that are not to emit light to zero.

The optical recording head according to the first aspect of this invention is basically designed in such a way that phosphor cells, anodes for supplying a potential to the phosphor cells, and a control electrode serving as a grid are provided on the same substrate, the control electrode surrounding the phosphor cells. This structure is simpler than that of the conventional optical recording head whose grid is located in the space between the filament cathode and the phosphor cells, and can eliminate the work of positioning the control electrode. This reduces the manufacturing cost. Further, since the uniform electric field distribution is formed with respect to the phosphor cells exposure, electrons evenly enter the phosphor cells, thus resulting uniform light emission.

According to the optical recording head of one mode of this invention, the control electrode is laid out partially overlapping the anodes while being electrically insulated from the anodes. It is therefore possible to set the area of the control electrode relatively wider than that in the case where the anodes and the control electrode are simply laid out on the same plane, thus allowing the control electrode to form a stable electric field. In this case, if the control electrode is laid out very close to the phosphor cells, the light emission control can be executed efficiency, thus ensuring stable light emission.

If the control electrode is placed on the anodes via an insulation layer to face the overlying cathode, the electrons emitted from the cathode can effectively be led into the control electrode. This prevents unnecessary charge injection into the anodes connected to non-emitting phosphor cells, thus ensuring stable light emission.

According to the optical recording head of another mode of this invention, an insulation layer is provided around the emission pixel areas of the phosphor cells and in gap areas between the emission pixel areas, and the control electrode is formed on this insulation layer. This allows the control electrode to be formed in the gap areas between the emission pixel areas relatively widely and close to the emission pixels, thus preventing the crosstalk between the adjacent emission pixels.

This control electrode can prevent the electrons emitted from the cathode from being accumulated on the substrate which is an electrically insulated area, thus ensuring stable light emission control. In addition, the control electrode is stacked on the anodes in the gap area between the emission pixel areas to effectively use the gap area, thus ensuring the high-density pixel layout for the optical recording head. If the substrate surface which faces the cathode is substantially covered with at least one of the phosphor cells, the anodes and the control electrode, desirably either the phosphor cells or the control electrode, unnecessary charges from the cathode can be led to the control electrode regardless of the light emission or the no light emission of the emission pixel areas, thus ensuring light emission.

Further, if the shape and size of the emission pixel areas are defined by the insulation layer while securing the emission pixel areas, the desired emission pixel areas can be formed even if the deposition precision of the phosphor cells is set relatively low, thus ensuring stable light emission.

According to the optical recording head of a further mode of this invention, as the control electrode forms a stronger electric field in the gap area between the adjacent emission pixel areas than in the other control electrode area, it is possible to reduce a variation in the amount of emitted light due to the disturbance of the electric field by the adjacent emission pixel areas and reduce the influence of the crosstalk on the light emission, thus ensuring stable light emission.

According to the optical recording head of a still further mode of this invention, since control electrodes corresponding to the individual emission pixel areas are provided around the associated emission pixels, the proper light emission control on the individual emission pixel areas can be executed even with a relatively simple structure.

Further, in this optical recording head, the potential of the control electrode with respect to the emission pixel areas to emit light and the potential of the control electrode with respect to the emission pixel areas which should not emit light are controlled to enable the proper light emission control on the individual emission pixel areas and facilitate the control of the emission of electrons from the cathode. In other words, even when the same amount of light emission is to be attained, the anode potential and the control electrode potential can be set low relative to each other, so that with the same potential given, the desired amount of light emission can be obtained without reducing the overall amount of light. Therefore, the light emission efficiency can be improved.

The following are the advantages of the first aspect of this invention.

(1) Since the phosphor cells, anodes and control electrode are formed on the same substrate, the optical recording head embodying the present invention can be manufactured at a relatively low cost.

(2) As the control electrode can be laid out in a relatively wide range, very close to the emission pixel areas, the light emission control is highly stable.

(3) As the control electrode can be laid out efficiently, it is easy to provide a high-density emission element array.

(4) As the electric field of the gap area between the adjacent emission pixel areas is set partially stronger than the other control electrode area, the overall amount of light is not reduced, and the amount of light is unlikely to vary even by the ON/OFF action of the adjacent emission pixels, thus ensuring stable light emission control.

(5) As the control electrode is provided for each emission pixel, the proper light emission control with suppressed crosstalk is easily executed and the applied voltage can be reduced without decreasing the amount of light emission. This can improve the light emission efficiency relatively.

An optical recording head according to the second aspect of this invention is characterized by comprising: a cathode for emitting electrons; an emission element array, provided apart from the cathode and having a substrate, a plurality of anodes arranged at predetermined intervals on the substrate, and a plurality of phosphor cells, arranged in contact to the anodes on the substrate, for emitting light based on the electrons from the cathode; and a plurality of control electrodes, provided at least two for each of the phosphor cells between the cathode and the emission element array, for accelerating the electrons from the cathode. Further, each of the plurality of control electrodes is divided into at least two parts in a layout direction of the plurality of phosphor cells.

The following are desirable modes of the optical recording head according to the second aspect.

(1) The control electrodes are laid out in such a way that a plurality of control electrodes associated with each of the phosphor cells surround that phosphor cell.

(2) The optical recording head further comprises an insulation layer disposed on the anodes, and the control electrodes are laid out on the substrate in such a way that each of the control electrodes partially overlaps an associated one of the anodes via the insulation layer.

(3) Each of the plurality of control electrodes is divided into at least two parts in a direction perpendicular to a layout direction of the phosphor cells.

(4) The plurality of control electrodes are laid out on the substrate.

According to the optical recording head of the second aspect of this invention, the control electrode corresponding to each of the phosphor cells is divided into a plurality of sub-control electrodes in, for example, the layout direction of the phosphor cells. By individually driving the sub-control electrodes, the launching positions of electrons from the cathode on the individual phosphor cells can be controlled. Accordingly, each of the emission pixels formed by the phosphor cells can be divided into a plurality of sub-light emission areas, which are to emit light. It is therefore possible to control the light emission of the emission pixels in finer units than one pixel, thus ensuring image recording at higher resolution than the layout density of the emission pixels.

In this case, if the control electrodes are formed together with the cathode and the phosphor cells on the same substrate and around the phosphor cells, the resultant structure is simpler than that of the conventional optical recording head whose grid is located in the space between the filament cathode and the phosphor cells, and can eliminate the work of positioning the control electrode. This reduces the manufacturing cost.

If the control electrodes are laid out partially overlapping the anodes while being electrically insulated from the anodes, each of the sub-control electrodes of each control electrode can have a wide area, so that the stable electric fields can be formed by the control electrodes, thus facilitating the stable control of the emission of the electrons from the cathode to the phosphor cells.

Further, if the control electrode is divided into a plurality of sub-control electrodes even in the direction perpendicular to the layout direction of the phosphor cells, the light emission of the emission pixels can be controlled more finely, thus ensuring image recording at higher resolution.

An image recording apparatus according to this invention is characterized by comprising: an optical recording head having a plurality of phosphor cells arranged in one row at least in a predetermined direction and dividing means for dividing each of the phosphor cells into a plurality of partial light emission areas in a layout direction of the phosphor cells; and tone control means for selectively enabling the plurality of partial light emission areas in accordance with tone image data. The tone control means includes means for controlling light emission times of the partial light emission areas. The optical recording head includes: a cathode for emitting electrons; an emission element array, provided apart from the cathode and having a substrate, a plurality of anodes arranged at predetermined intervals on the substrate, a plurality of phosphor cells, arranged in contact to the anodes on the substrate, for emitting light based on the electrons from the cathode; and a plurality of control electrodes, provided at least two for each of the phosphor cells between the cathode and the emission element array, for accelerating the electrons from the cathode, each of the control electrodes being divided into at least two parts in the layout direction of the phosphor cells.

According to the image recording apparatus embodying this invention, each emission pixel is divided into a plurality of sub-light emission areas which are selectively activated to emit light in accordance with tone image data to record a tone image. Even with the use of an optical recording head which utilizes the light emission of phosphor cells and whose layout density of the emission pixels is not easily improved, therefore, the gray scale can be improved without lowering the resolution.

When the sub-light emission areas are selectively driven, the light emission times of the sub-light emission areas may also be controlled in accordance with the tone image data to alter the light emission pattern in the sub-scanning direction, thus ensuring richer tone expression.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIGS. 17A and 17B are exemplary diagrams for explaining the relation between the exposure time of the emission pixels of the optical recording head according to the ninth embodiment and the amount of exposure on a photosensitive drum;

FIGS. 18A to 18D are diagrams showing exposure patterns for expressing five tones by the image recording apparatus according to the ninth embodiment;

FIGS. 24A and 24B are diagrams showing the relation between the layout of tone image data and the layout of exposure data areas;

FIGS. 25A and 25B are diagrams exemplifying a table stored in a tone conversion section in the tone control section in FIG. 22;

DETAILED DESCRIPTION OF THE PREFERRED EMBODIMENTS

Preferred embodiments of the present invention will now be described referring to the accompanying drawings.

The basic structure of an optical recording head embodying the present invention will be described with reference to FIG. 1, which is a partly cutaway perspective view showing the schematic structure of an optical recording head 20.

Figure 1:
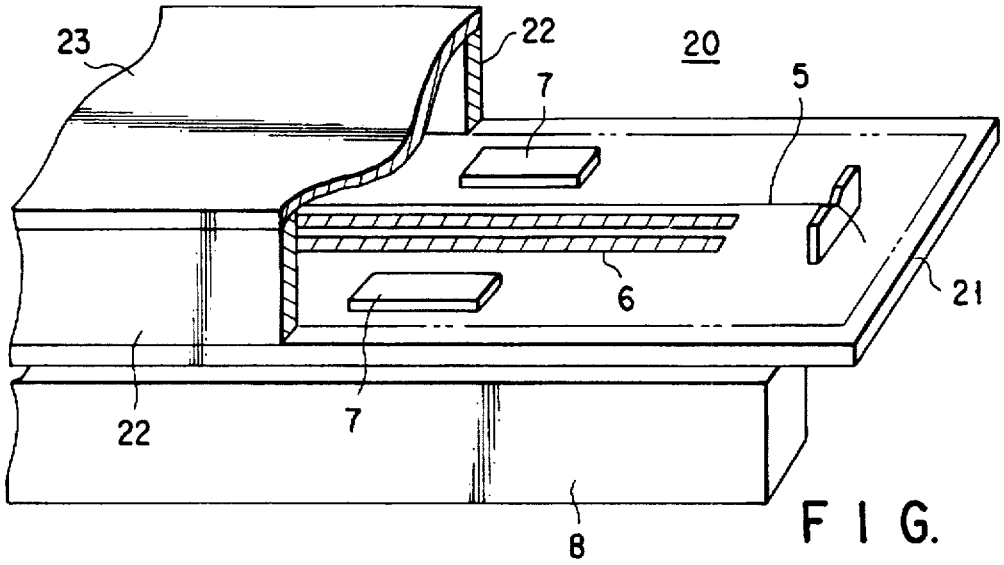
FIG. 1 is a diagram showing the schematic structure of an optical recording head according to the present invention.

In FIG. 1, a side glass 22 and a cover glass 23 are provided on a transparent glass substrate 21 having an electric insulation property to form a air-tight chamber which is kept vacuum of about $10^{-8}$ Torr. An emission element array 6 is provided on the glass substrate 21, and a filament cathode (hereinafter simply called "cathode") 5 is laid out above the emission element array 6 with some space therebetween. The cathode 5 is made of a tungsten core with a diameter of about 10 μm coated with a carbonate ($BaCO_3$, $SrCO_3$, $CaCO_3$), and emits electrons when applied with a voltage of several volts. A driving circuit 7 for controlling the emission element array 6 receives a signal from outside the emission element array 6 via an unillustrated signal line, and supplies a needed voltage to anodes, etc. of the emission element array 6, which will be discussed later in detail.

The light emission and non-emission of the emission element array 6 are controlled by selectively applying an electric field between the anodes, connected to individual emission pixel areas, and the cathode 5. The light emitted from the phosphor cells passes the transparent glass substrate 21 and is then used via an imaging system such as a rod lens array 8.

Various embodiments of the emission element array 6, which is the essential part of the present invention, will now be discussed.

Figure 2A:
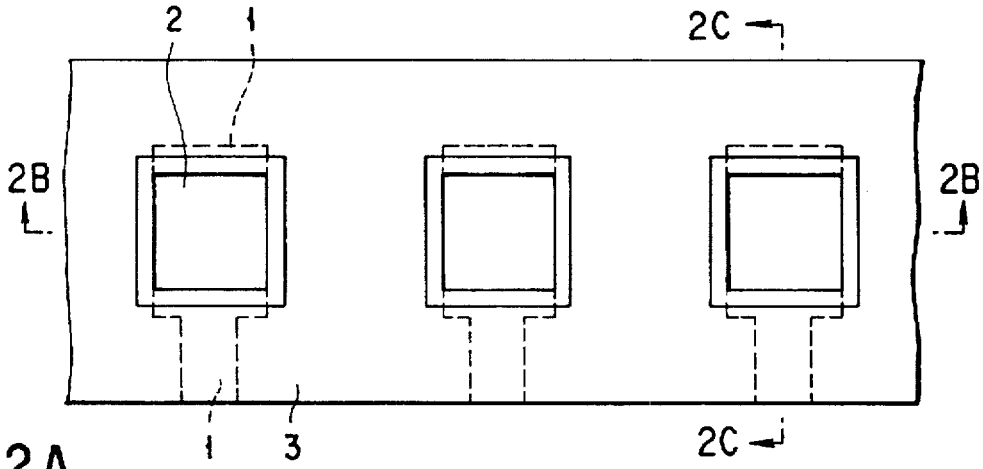
FIGS. 2A to 2C are a plan view and cross-sectional views showing the schematic structure of an emission element array of an optical recording head according to a first embodiment.
Figure 2B:
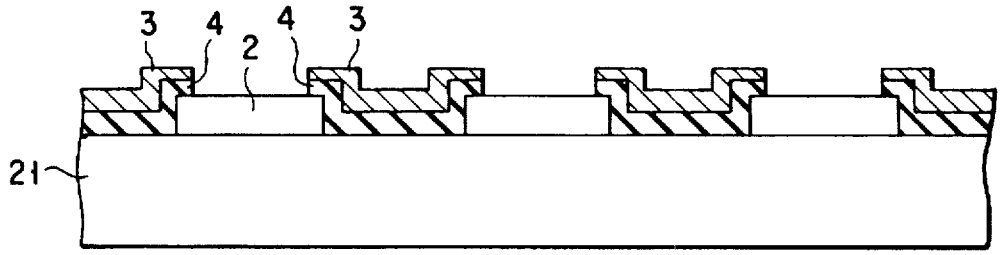
Figure 2C:
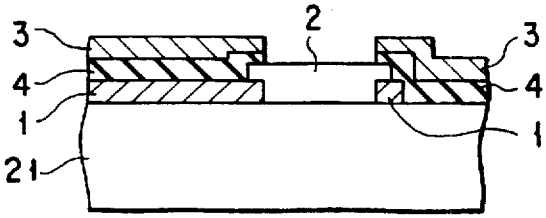

FIGS. 2A to 2C illustrate an emission element array according to a first embodiment. FIG. 2A shows, in enlargement, a part of one row of two rows of emission element arrays which are laid out in staggered form. FIGS. 2B and 2C are cross sections of that row along 2B—2B and 2C—2C in FIG. 2A, respectively.

A plurality of anodes 1 are laid out on the glass substrate 21 having an electric insulation property, at given intervals in the emission element layout direction, and phosphor cells 2 for forming emission pixels are formed in such a manner that their edge portions overlap the anodes 1. The anodes 1 are made of a conductive material like aluminum or ITO (Indium Tin Oxide), and are formed by the thin film print technology, such as sputtering. The phosphor cells 2 are formed of, for example, ZnO:Zn by the thick film print technology, such as screen printing.

An insulation layer 4 is provided on the substrate 21 in such a way as to cover the edge portions of the anodes 1 in the emission element layout direction and surround the phosphor cells 2. A control electrode 3, like the insulation layer 4, is provided on the insulation layer 4 so as to surround the phosphor cells 2. The control electrode 3 accelerates the emission of electrons from the cathode 5 which occurs when an electric field is uniformly applied between the control electrode 3 and the cathode 5 in FIG. 1.

The insulation layer 4 is formed of an electrically insulative material, such as $SiO_2$ or polyimide, by sputtering. The insulation layer 4 electrically insulates the anodes 1 from the control electrode 3.

The control electrode 3 partially overlaps the anodes 1 via the insulation layer 4 as shown in FIG. 2C. That is, the control electrode 3 is formed to be as close to the phosphor cells 2 as possible. If this arrangement is not taken, the control electrode 3 is still formed to surround the phosphor cells 2. Accordingly, the electrons emitted from the cathode 5 in FIG. 1 located above the emission pixel areas are stably accelerated by the electric field of the control electrode 3 formed in a wide area. More specifically, no electrons are emitted to the phosphor cells 2 of the emission pixel areas which do not emit light as no voltage is applied to the associated anodes 1 whose ON/OFF actions are individually controlled, and the electrons are caught by the control electrode 3, while the proper voltage is applied to the enabled (ON) anodes 1 so that the electrons hit the phosphor cells 2 to emit light.

The control electrode 3 should not necessarily cover all the anodes 1, but it is desirable that the control electrode 3 be stacked on the anodes 1 via the insulation layer 4 in the areas close to the emission pixel areas in view of the influence on the electron emission in the emission pixel areas. It is also desirable that the control electrode 3 be formed, widely covering the anodes 1 so that a stable electric field is formed by the voltage applied to the control electrode 3. If the layout range of the control electrode 3 is set slightly narrower than the deposition range of the insulation layer 4 in view of the printing precision, the electric short-circuiting between the anodes 1 and the control electrode 3 near the emission pixel areas can be avoided, and the layout area of the control electrode 3 can be widen as much as possible in accordance with this printing precision.

Figure 3A:
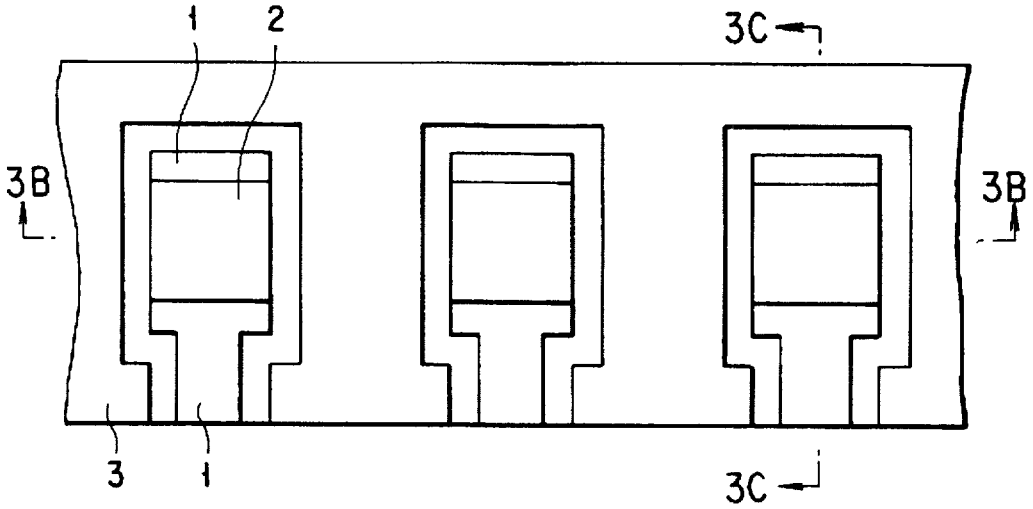
FIGS. 3A to 3C are a plan view and cross-sectional views showing the schematic structure of another example of the emission element array of the optical recording head.
Figure 3B:
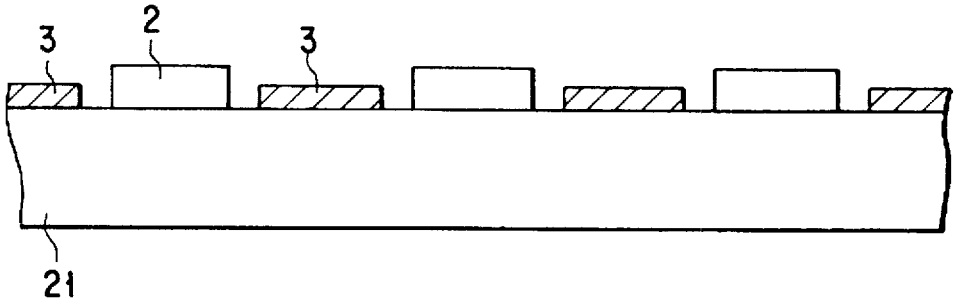
Figure 3C:
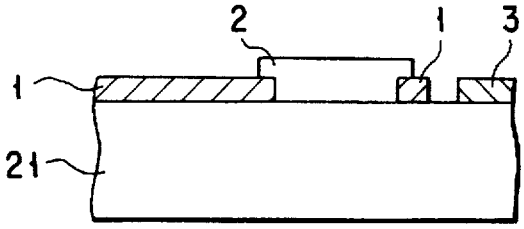

FIGS. 3A to 3C illustrate an emission element array of the optical recording head as a comparative example to the one shown in FIGS. 2A to 2C. FIGS. 3B and 3C are cross sections along 3B—3B and 3C—3C in FIG. 3A, respectively. In this comparative example, the control electrode 3 is also illustrated to surround the phosphor cells 2.

As the optical recording head shown in FIGS. 3A to 3C has the control electrode 3 formed to surround the phosphor cells 2, the electric field distribution around the phosphor cells 2 becomes uniform. This is desirable because electrons uniformly enter the whole phosphor cells 2. Since the control electrode 3 is not laid out in the areas of the anodes 1 as compared with the structure shown in FIGS. 2A to 2C, no voltage is applied to the anodes 1 in the emission pixel areas that should not emit light, and the electric field formed near those areas by the control electrode 3 is weak. Therefore, the electrons from the cathode 5 may not be controlled properly so that the electrons from the cathode 5 may reach the phosphor cells 2 in the non-emission pixel areas in some case.

In the first embodiment shown in FIGS. 2A to 2C, as the control electrode 3 is provided partially overlapping the anodes 1 to the close vicinity of the phosphor cells 2, the launching positions of the electrons from the cathode 5 in FIG. 1 can properly be controlled by the electric field formed by the voltage application to the control electrode 3.

Further, since the area of the control electrode 3 in the first embodiment can be set relatively wider than that of the control electrode in FIGS. 3A to 3C, a uniform electric field can be formed by the control electrode 3, so that the stability of the light emission control can be improved.

Furthermore, even if each phosphor cell 2 is formed wider than a predetermined area, the shape of the opening of the phosphor cell 2 where the electrons enter can be defined by the insulation layer 4. Even if the phosphor cells 2 are formed by the thick film printing technology of a lower printing precision than the thin film printing technology, therefore, stable emission elements can be formed.

According to the first embodiment in FIGS. 2A to 2C, the control electrode 3 can substantially be formed very close to the phosphor cells 2, so that the width of the control electrode located between adjacent two emission pixels can be set relatively wide. In other words, if the control electrode is made as narrow as to the level at which the crosstalk between the adjacent two emission pixels is negligible, the emission pixels can be laid out with a high density.

By properly selecting the size of the emission pixels by the phosphor cells (the width in the emission element layout direction) and the width of the control electrode, the emission element array may be laid out in one row, instead of two rows of emission element arrays arranged in staggered manner.

Figure 4A:
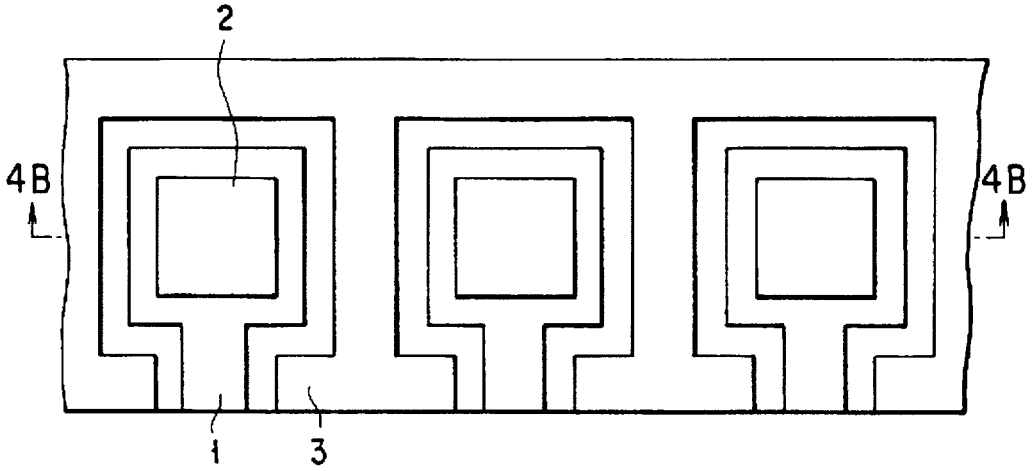
FIGS. 4A and 4B are a plan view and a cross-sectional view showing the schematic structure of an emission element array of an optical recording head according to a second embodiment.
Figure 4B:
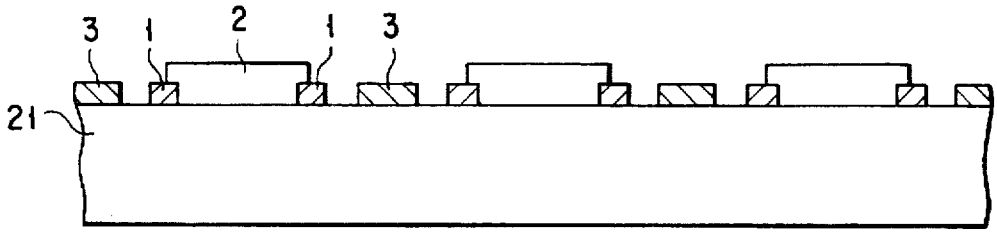

FIGS. 4A and 4B illustrate an emission element array according to a second embodiment, FIG. 4B showing a cross section along 4B—4B in FIG. 4A.

The emission element array according to the second embodiment is the emission element array of the optical recording head in FIGS. 3A to 3C which is formed in is such a way that the shape of the emission pixel areas of the phosphor cells 2 is defined to be rectangular by the anodes 1. According to the second embodiment, the shape of the emission pixels can be defined accurately even if the deposition areas of the phosphor cells vary.

Figure 5A:
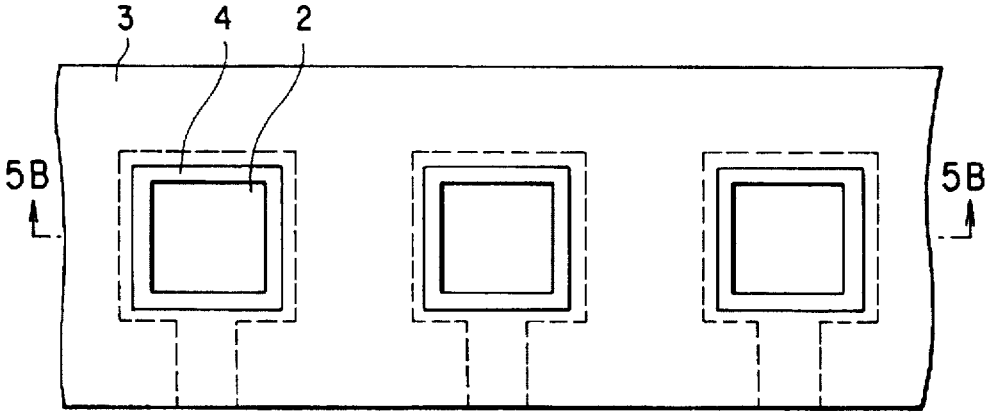
FIGS. 5A and 5B are a plan view and a cross-sectional view showing the schematic structure of an emission element array of an optical recording head according to a third embodiment.
Figure 5B:
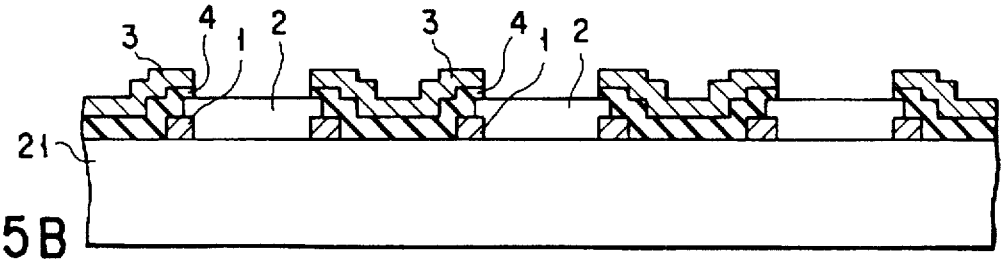

FIGS. 5A and 5B illustrate an emission element array according to a third embodiment, FIG. 5B showing a cross section along 5B—5B in FIG. 5A.

The emission element array according to the third embodiment is formed in such a manner that the shape of the emission pixels of the phosphor cells 2 is defined by the anodes 1 as per the second embodiment, and that the control electrode 3 is stacked on the insulation layer 4 which is deposited on the anodes 1. According to the third embodiment, the control electrode 3 can be laid out in a wider area and very close to the emission pixel areas as compared with the second embodiment shown in FIGS. 4A and 4B, so that the electrons emitted from the cathode can be efficiently and properly controlled by the control electrode 3.

Figure 6:
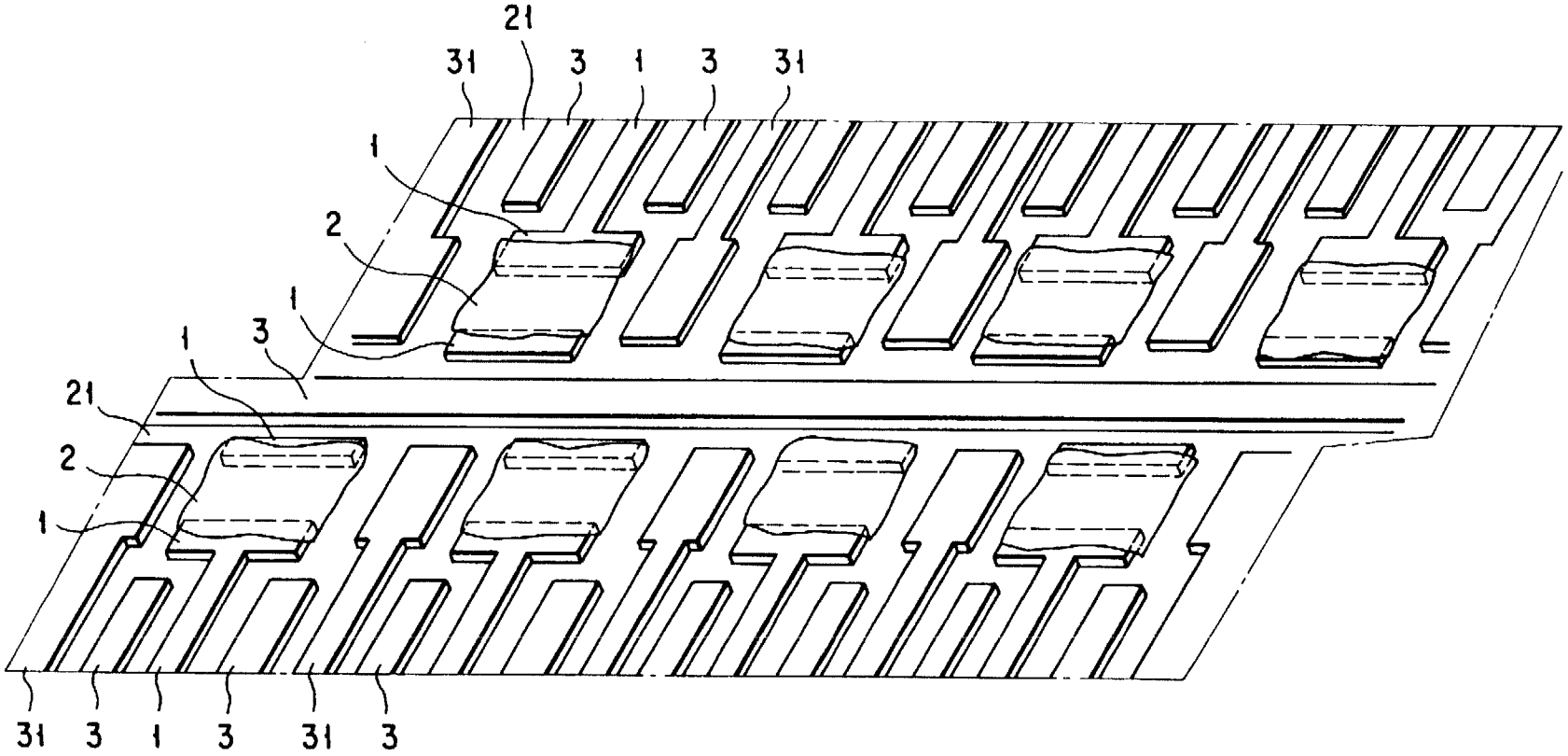
FIG. 6 is a perspective view showing the schematic structure of an emission element array of an optical recording head according to a fourth embodiment.

FIG. 6 illustrates an emission element array according to a fourth embodiment. In the fourth embodiment, the phosphor cells 2 are partially deposited on the anodes 1 to provide excellent connection to the anodes 1. Since the light emitted from the phosphor cells 2 is utilized after having passed the glass substrate 21, the shape or the size of each emission pixel area is partially defined by the edge portions of the associated anode 1; this shape or size is defined in the up and down direction in FIG. 6. The range of each emission pixel area in the right and left direction is defined by the deposition precision of the associated phosphor cell 2.

A first control electrode 3 of aluminum or the like is formed by sputtering on the glass substrate 21 in areas around the anodes 1 and insulated therefrom. It is desirable that this first control electrode 3 be formed in as a wide range as possible around the emission pixel areas in order to form a uniform electric field.

A second control electrode 31 is formed on the glass substrate 21 in a gap area between adjacent emission pixel areas, as insulated from the anodes 1 and the first control electrode 3. The second control electrode 31 can be formed of the same material and in the same step as the first control electrode 3. The first control electrode 3 and the second control electrode 31 may be formed simultaneously with a single mask pattern, unless a specific problem occurs.

With the above structure, a constant voltage is applied between the cathode 5 in FIG. 1 and the first and second control electrodes 3 and 31 to accelerate the emission of the electrons from the cathode 5. The voltage is properly set in such a way that when no voltage is applied to the anodes 1 to emit no light, the electrons from the cathode 5 do not hit the emission pixel areas of the phosphor cells 2.

Normally, when the voltage applied to the first control electrode 3 is too high, the electric field to be formed becomes strong enough to hinder the launching of the electrons to the emission pixel areas of the phosphor cells 2 that should emit light, thus reducing the amount of emitted light or lowering the light emission efficiency.

In view of the above, the fourth embodiment has the second control electrode 31 in addition to the first control electrode 3 to avoid such reduction in light emission efficiency. That is, the first control electrode 3 forms the whole or a wide range of an electric field to control the launching of the electrons from the cathode 5, while the second control electrode 31 is provided in the gap area between the emission pixel areas to prevent the crosstalk between the adjacent emission pixel areas and reduce a variation in the amount of light emission disturbed by the electric field that is caused by the ON/OFF actions of the adjacent emission pixel areas.

Normally, a voltage of several tens of volts is applied to the first control electrode 3 and a higher and a voltage higher than several volts than that of the first control electrode 3 is applied to the second control electrode 31 to form a partially strong electric field only in the gap area between the adjacent emission pixel areas, thus ensuring stable light emission control, while an unnecessary emphasis of the electric field over the whole areas is avoided.

Figure 7A:
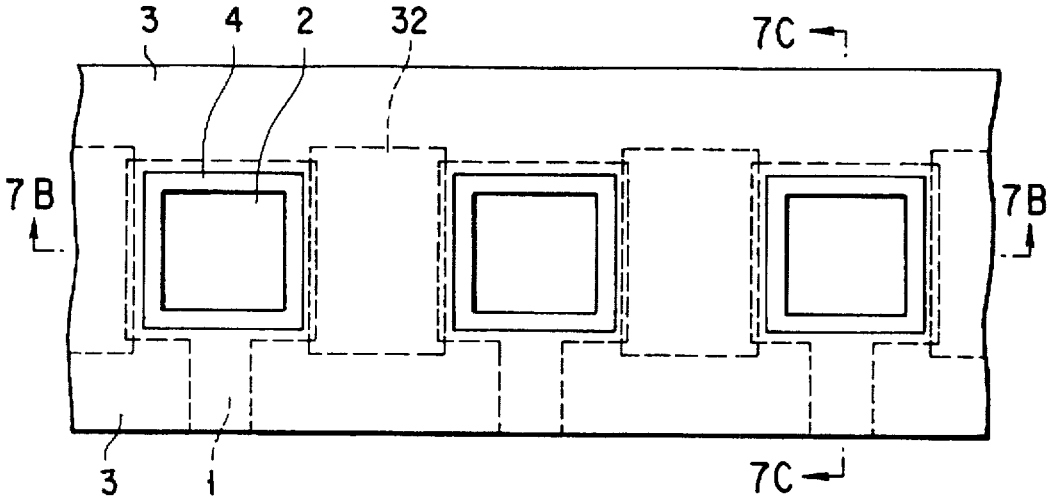
FIGS. 7A to 7C are a plan view and cross-sectional views showing the schematic structure of an emission element array of an optical recording head according to a fifth embodiment.
Figure 7B:
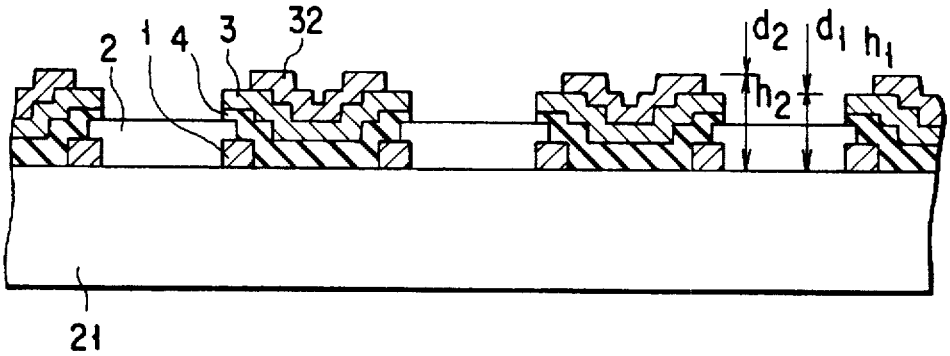
Figure 7C:
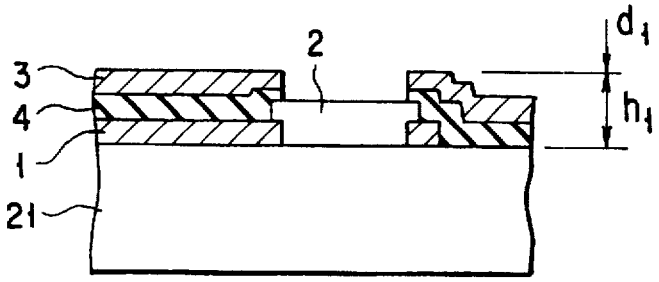

FIGS. 7A to 7C illustrate an emission element array according to a fifth embodiment, FIGS. 7B and 7C respectively showing cross sections along 7B—7B and 7C—7C in FIG. 7A.

In the emission element array according to the fifth embodiment, the insulation layer of $SiO_2$ or polyimide is formed as close to the emission pixel areas as possible in such a way as to partially overlap the anodes 1 and phosphor cells 2 and to define the frames of the emission pixel areas, and the control electrode 3 of aluminum or the like is deposited on the insulation layer 4. The control electrode 3 is formed on substantially the entire surface excluding the emission pixel areas.

A partial control electrode 32 is deposited on the partial area of the control electrode 3 (the area encircled by the broken line in FIG. 7A) located in the gap area between the adjacent emission pixel areas so that the thickness of the control electrode 3 is increased. The partial control electrode 32 is a part of the control electrode 3 and both electrodes can be formed of substantially the same material.

The provision of the partial control electrode 32 on the control electrode 3 in the mentioned manner sets the height h2, from the glass substrate 21 to the partial control electrode 32 higher than the height h1, from the glass substrate 21 to the control electrode 3. Therefore, the distance d2, between the cathode 5 in FIG. 1 located above the phosphor cells 2 and the partial control electrode 32 becomes shorter than the distance d1, between the cathode 5 and the control electrode 3. If the equal potential is given to the control electrode 3 and the partial control electrode 32, the electric field formed between the cathode 5 and the partial control electrode 32 becomes relatively stronger than that formed between the cathode 5 and the control electrode 3.

Accordingly, like the fourth embodiment, the fifth embodiment can improve the instability of light emission due to the crosstalk by the relatively strong electric field in the gap area between the emission pixel areas, thus preventing the reduction in the amount of emitted light.

Figure 8A:
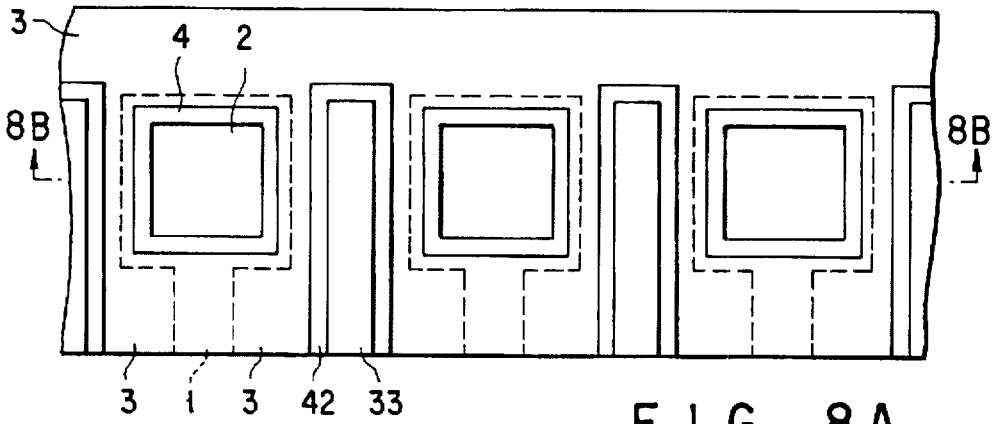
FIGS. 8A and 8B are a plan view and a cross-sectional view showing the schematic structure of an emission element array of an optical recording head according to a sixth embodiment.
Figure 8B:
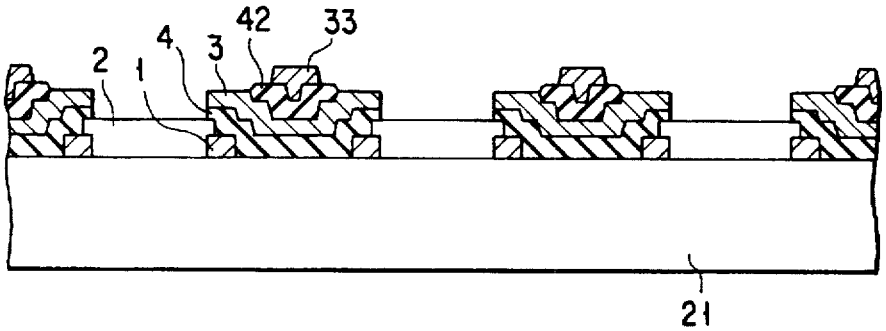

FIGS. 8A and 8B illustrate an emission element array according to a sixth embodiment, FIG. 8B showing a cross section along 8B—8B in FIG. 8A. In the emission element array according to the sixth embodiment, a second insulation layer 42 is deposited partially on the control electrode 3 in the gap area between the emission pixel areas of the phosphor cells 2, and a second control electrode 33 is further deposited on the second insulation layer 42 so as to keep the electric insulation from the control electrode 3.

With the above structure, the proper voltages are respectively supplied to the control electrode 3 and the second control electrode 33. The launching of the electrons from the cathode 5 in FIG. 1 is dominantly controlled in a midway between two adjacent emission pixel areas by the electric field formed by the second control electrode 33, and is roughly controlled in the other area by the electric field formed by the control electrode 3. Like the fourth embodiment, therefore, this embodiment can ensure stable light emission without lowering the light emission efficiency.

As the second control electrode 33 formed in the partial area is deposited on the control electrode 3 and the second insulation layer 42 in the sixth embodiment, the distance from the cathode 5 to the second control electrode 33 can be made shorter than the distance to the other area. This embodiment can therefore produce the same effect as the fifth embodiment. That is, the sixth embodiment can expect the advantages of the fourth and fifth embodiments at the same time.

Figure 9A:
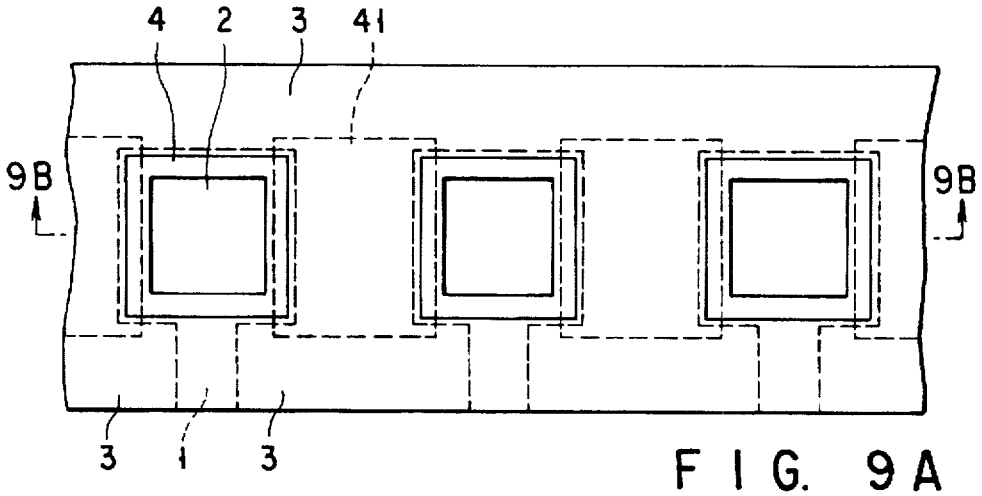
FIGS. 9A and 9B are a plan view and a cross-sectional view showing the schematic structure of an emission element array of an optical recording head according to a seventh embodiment.
Figure 9B:
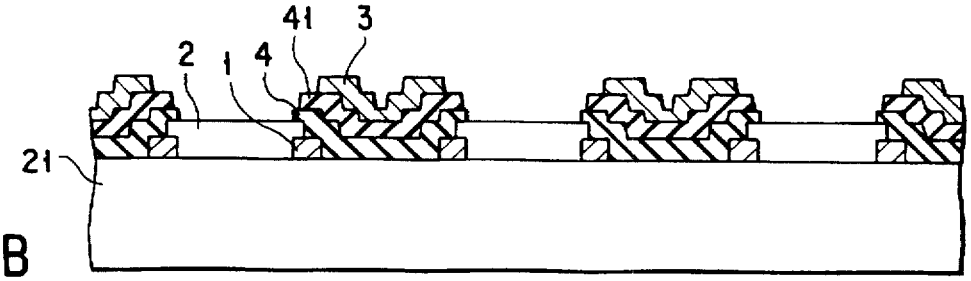

FIGS. 9A and 9B illustrate an emission element array according to a seventh embodiment, FIG. 9B showing a cross section along 9B—9B in FIG. 9A. In the emission element array according to the seventh embodiment, after the insulation layer 4 is formed, a partial insulation layer 41 is deposited only on the insulation layer 4 located in the gap area between the adjacent emission pixel areas and the control electrode 3 is formed to almost cover the insulation layer 4 and the partial insulation layer 41.

According to the seventh embodiment, the distance between the control electrode area where the partial insulation layer 41 is provided and the cathode located above becomes shorter than the distance between the other control electrode area and the cathode due to nearly the same action of the fifth embodiment, and the electric field formed between the former control electrode area and the cathode becomes partially stronger, thus providing an improved stability of light emission in that area.

The thickness of the partial insulation layer formed in the gap area between the emission pixel areas should be set to the needed and proper value in accordance with the strength of the electric field formed between the control electrode 3 and the cathode 5 in FIG. 1.

Figure 10A:
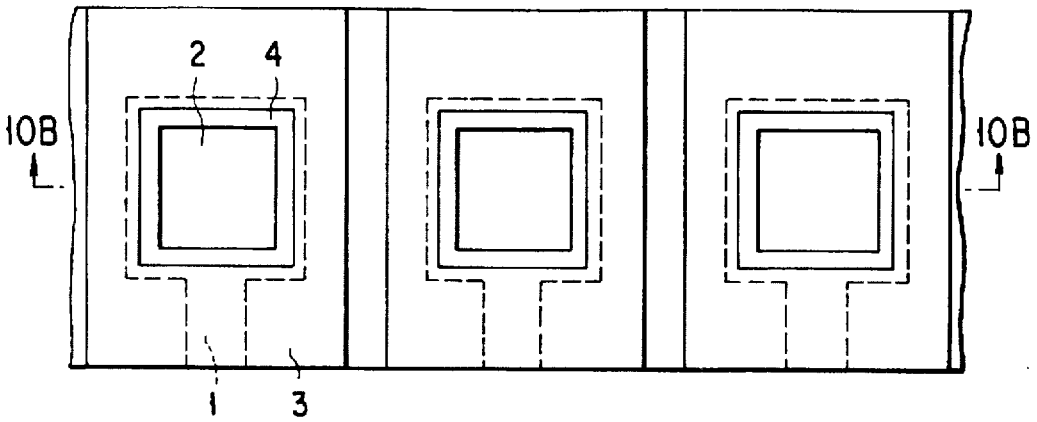
FIGS. 10A and 10B are a plan view and a cross-sectional view showing the schematic structure of an emission element array of an optical recording head according to an eighth embodiment.
Figure 10B:
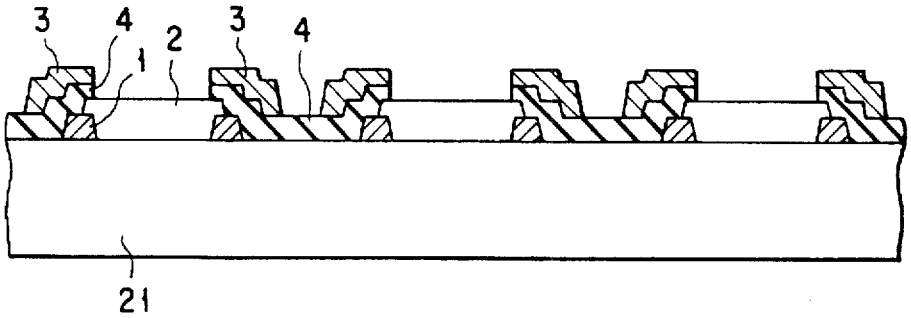

FIGS. 10A and 10B illustrate an emission element array according to an eighth embodiment, FIGS. 10B showing a cross section along 10B—10B in FIG. 10A. In the emission element array according to the eighth embodiment, the insulation layer 4 is deposited on the substrate 21 in such a way as to partially overlap the anodes 1 and the phosphor cells 2. The shape and size of the emission pixel areas of the phosphor cells 2 may be defined by the edge portions of the insulation layer 4, in which case the light from the phosphor cells 2 toward the cathode 5 in FIG. 1 can be utilized as well as the light from the phosphor cells 2 after having passed the transparent substrate 21.

The control electrodes 3 are deposited on the insulation layer 4 around the emission pixel areas of the phosphor cells 2 to surround the emission pixel areas in the eighth embodiment. The control electrodes 3 are independently provided for the respective emission pixel areas. The individual control electrodes 3 are electrically insulated from one another with a slight gap between the adjacent control electrodes. Those control electrodes 3 are connected to a driving circuit so as to independently control the ON/OFF state of the voltage or the value of the supplied voltage.

The optical recording head according to the eighth embodiment is driven by the properly set voltage supplied to the anodes 1 and control electrodes 3, which are associated with the emission pixel areas. To emit light from the emission pixel areas of the phosphor cells 2, the set voltage is applied to the anodes 1 associated with the emission pixel areas that should emit light, forming an electric field between those areas and the cathode 5. This electric field accelerates the electrons emitted from the cathode 5 toward the anodes 1 and the accelerated electrons hit against the phosphor cells 2 electrically connected to those anodes 1, thus effecting light emission. If the phosphor cells 2 have some conduciveness, the potentials given to the anodes 1 are also given to the associated phosphor cells 2. At this time, a voltage lower than that of the anodes 1 or a voltage of the opposite polarity to that of the anodes 1 is applied or is not applied to the control electrodes 3 provided around the emission pixel areas that should emit light. When the voltage lower than that of the anodes 1 is applied to the control electrodes 3, the electric field formed by the control electrodes 3 can permit the electrons coming around the emission pixel areas that should emit light from the cathode 5 to efficiently hit against the phosphor cells 2 together with the electronic lens effect.

When the emission pixel areas of the phosphor cells 2 should not emit light, the application of the voltage to the anodes 1 associated with the emission pixel areas that should not emit light is suppressed while the application of the voltage to the control electrodes 3 provided around the associated emission pixel areas that should not emit light is set higher than the voltage to the anodes 1. The value of the voltage applied to the control electrodes 3 is set so that the electric field formed by the control electrodes 3 do not cause the electrons emitted from the cathode 5 to collide on the phosphor cells 2 associated with the emission pixel areas that should not emit light. The crosstalk can be prevented by setting this voltage value so that the voltage does not affect the electrons which travel to the adjacent emission pixel areas, as much as possible.

The values of the voltages applied to the anodes 1 and the control electrodes 3 depend on the distance from the cathode 5, and the size and the layout density of the emission pixel areas. Normally, a voltage of about 30 V is applied to the anodes 1 and a voltage of about 0 to 10 V is applied to the control electrode 3 for the emission pixel areas that should emit light, and normally, a voltage of about 0 to −10 V is applied to the anodes 1 and a voltage of about 40 V is applied to the control electrode 3 for the emission pixel areas that should not emit light.

Since the voltages applied to the anodes 1 and control electrodes 3 of the optical recording head of the eighth embodiment can be suppressed to relatively low values, the light emission efficiency can be improved. Further, because of the suppression of the applied voltages to the anodes 1 and the control electrodes 3, a driving element of a low breakdown voltage can be employed, resulting in an additional advantage of facilitating fast driving.

One example of the method of driving the optical recording head of the eighth embodiment will now be described.

Figure 11:
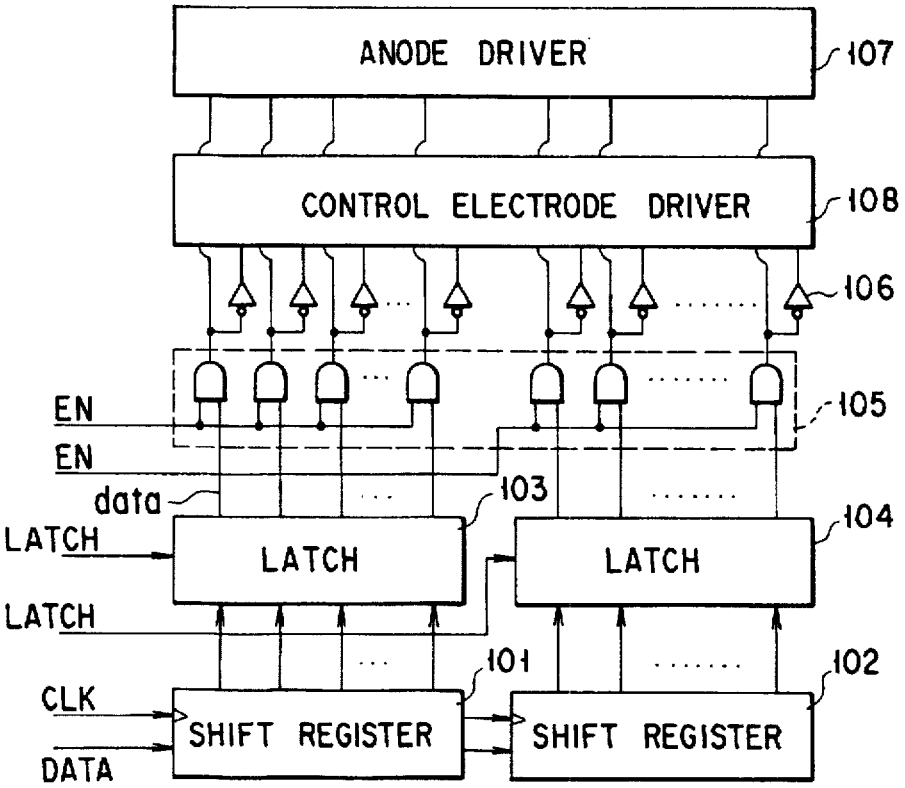
FIG. 11 is a block diagram showing the structure of a driving circuit section for the optical recording head according to the eighth embodiment.
Figure 12:
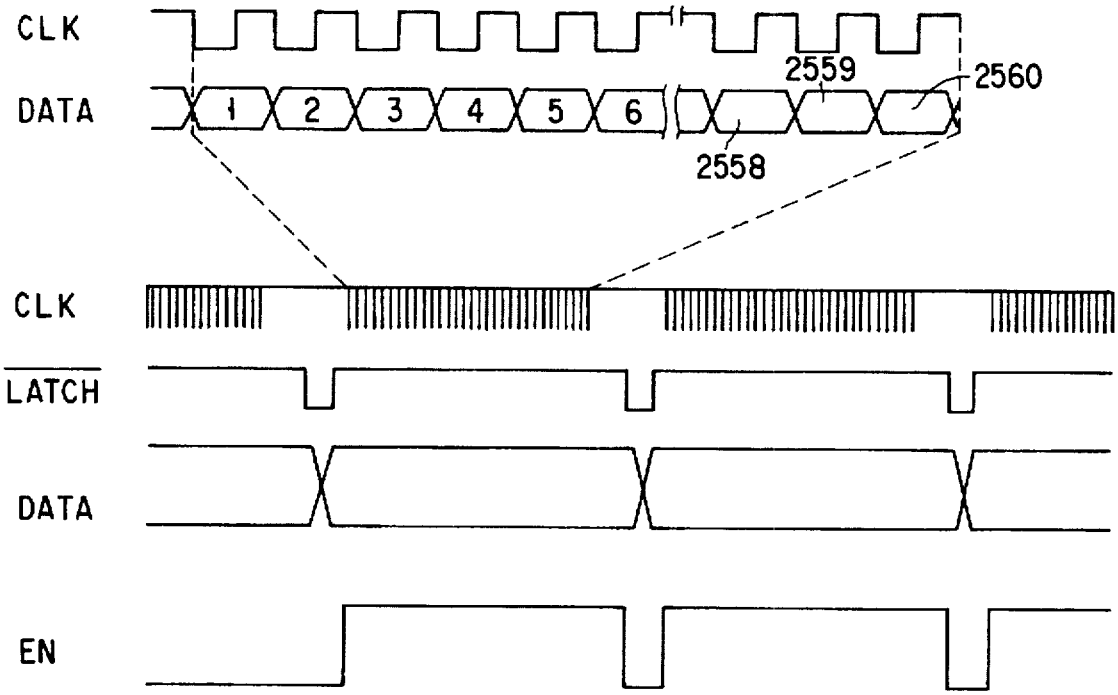
FIG. 12 is a time chart for explaining the operation of the driving circuit section in FIG. 11.

FIG. 11 is a block diagram showing the structure of a driving circuit adapted for the optical recording head of this invention, and FIG. 12 is a time chart illustrating the operation of the driving circuit. The driving circuit comprises shift registers 101 and 102, latch circuits 103 and 104, a gate circuit 105, inverters 106, an anode driver 107 and a control electrode driver 108.

In FIG. 11, digital emission data DATA consisting of data indicating whether or not the emission pixel areas should emit light is input to the shift register 101 at a predetermined transfer speed in response to a clock CLK. The shift registers 101 and 102 are each constituted by cascade connection of a plurality of shift register elements (flip-flops), and the output of the shift register 101 is input to the next stage of the shift register 102.

Suppose that the optical recording head has a total of 2560 emission pixels and 2560 pieces of data are transferred and input to the shift registers 101 and 102 from an external device. The data in the shift registers 101 and 102 are latched by the latch circuits 103 and 104 in response to a latch signal LATCH. The output data "data" of the latch circuits 103 and 104 are held until the next latch signal LATCH comes, so that during this period the next emission data DATA can be transferred to the shift registers 101 and 102.

When an emission enable signal EN is supplied to the gate circuit 105, the output data of the latch circuits 103 and 104 are supplied to the anode driver 107 and the control electrode driver 108 via the gate circuit 105 to apply predetermined voltages to the anodes 1 and the control electrodes 3. At this time, the outputs of the gate circuit 105 are supplied with the unchanged phase to the anode driver 107, and are supplied to the control electrode driver 108 after being inverted by the inverters 106. While the anodes 1 are selected to be enabled, therefore, the control electrodes 3 are disabled. When the anodes 1 are selected to be enabled, however, the control electrodes 3 may not be set to 0 V but a predetermined voltage of about 10 V may be supplied to the control electrodes 3. In this case, the outputs of the control electrode driver 108 should be pulled up.

When the voltage is applied to the anodes 1 in the above manner, the emission pixel areas of the phosphor cells 2 emit light based on the emission data DATA during the period where the emission enable signal EN is applied. In this case, the launching direction of the electrons from the cathode 5 is properly controlled by the control electrodes 3 individually provided around the associated emission pixel areas that have emitted light, thus accomplishing stable light emission.

Although the foregoing descriptions of the first to eighth embodiments have been given with reference to the structure that causes the light from the emission pixel areas to pass through the glass substrate 21 before being utilized, the light from the phosphor cells 2 may be guided outside from a surface different from the surface of the glass substrate 21, e.g., the surface of the cover glass 23. In this case, the glass substrate 21 does not need the transmittivity, so that a ceramic substrate or the like may be used as well.

Figure 13C:
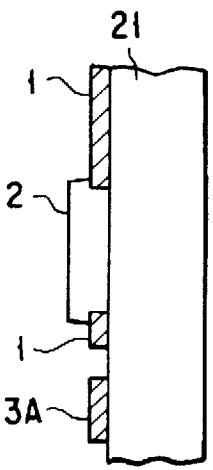
FIGS. 13A to 13C are a plan view and cross-sectional views showing the schematic structure of an emission element array of an optical recording head according to a ninth embodiment.
Figure 13B:
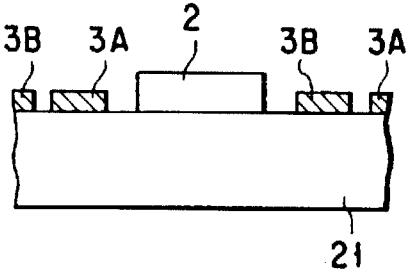
Figure 13A:
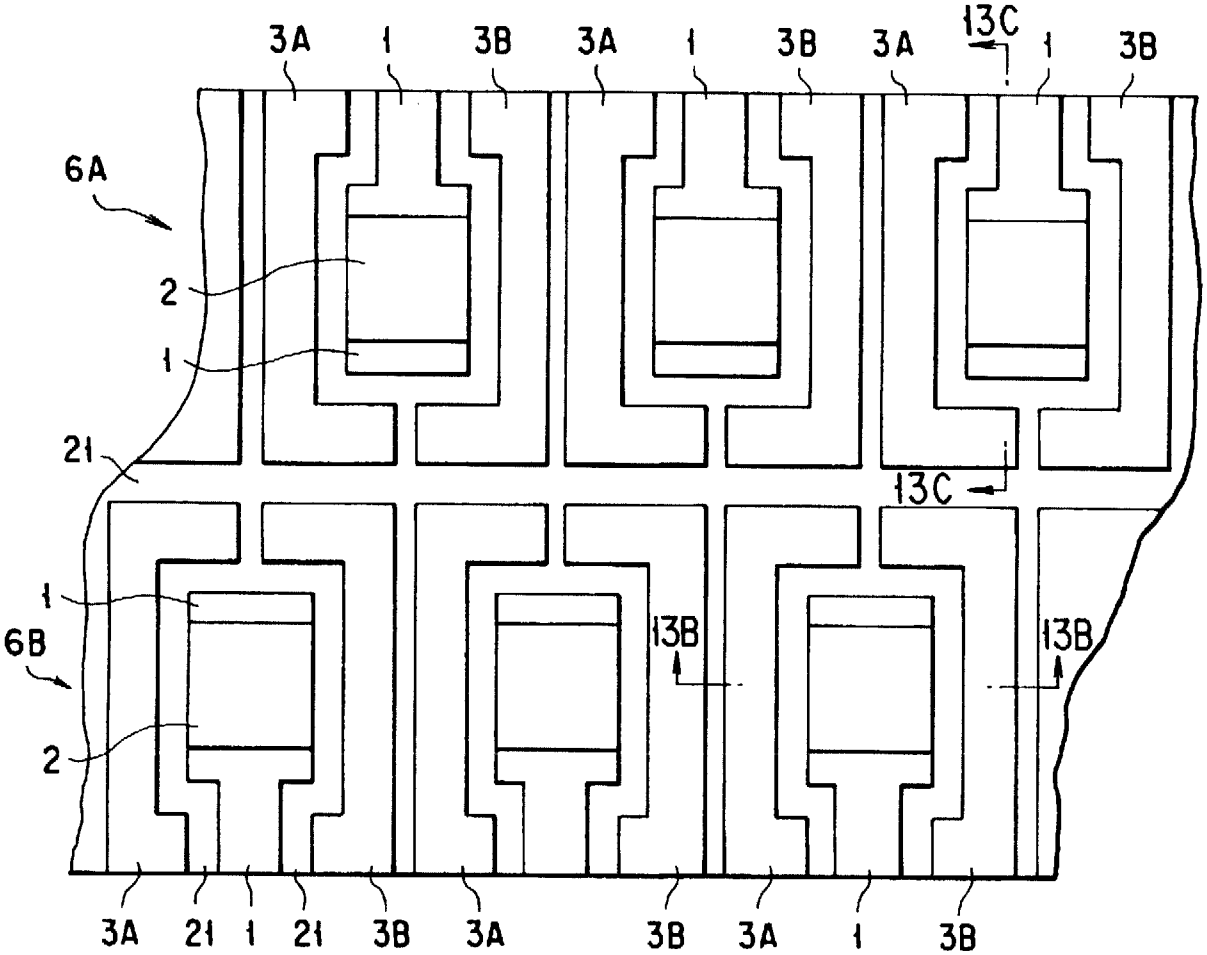

FIGS. 13A to 13C illustrate an emission element array according to a ninth embodiment, FIGS. 13B and 13C respectively showing cross sections along 13B—13B and 13C—13C in FIG. 13A.

In the ninth embodiment, the emission element array 6 comprises two rows of emission element arrays 6A and 6B arranged in staggered fashion. A plurality of anodes 1 are laid out on the glass substrate 21 having an electric insulation property, at given intervals in the emission element layout direction, and phosphor cells 2 for forming emission pixels are formed in such a manner that their edge portions overlap the anodes 1. The anodes 1 are made of a conductive material like aluminum or ITO (Indium Tin Oxide), and are formed by sputtering or the like. The phosphor cells 2 are formed of, for example, ZnO:Zn by the thick film print technology, such as screen printing. In the ninth embodiment, the phosphor cells 2 are given a slight conductivity so that the potential of the anode 1 is evenly applied to the entire area of the associated phosphor cell 2. In this case, the anode 1 and the phosphor cell 2 have substantially the same potential.

Control electrodes 3A and 3B, bisected in the layout direction of the phosphor cells 2 (the layout direction of the emission pixels), are laid out on the substrate 21 so as to nearly surround the associated phosphor cell 2. The control electrodes 3A and 3B are formed of a conductive material, such as aluminum or ITO, like the material for the anodes 1, by sputtering. As the control electrodes 3A and 3B are both formed on the same substrate 21 or on the same plane, the same mask pattern may be used to form those electrodes. The resultant structure is therefore simpler than that of the conventional optical recording head whose grid is located in the space between the filament cathode and the phosphor cells and ensures easier formation of the control electrodes 3A and 3B. In addition, this structure can eliminate the work of positioning the control electrodes 3A and 3B and can allow the control electrodes 3A and 3B to be formed at high precision. It is therefore possible to make the gaps between the interconnections as narrow as possible within the range where the insulation of the control electrodes 3A and 3B is secured, and to lay out the control electrodes 3A and 3B efficiently in limited space.

The anodes 1 and the control electrodes 3A and 3B are connected to the driving circuit 7 shown in FIG. 1 by unillustrated lead lines. In this case, the anodes 1 and the control electrodes 3A and 3B of the upper emission element array 6A in FIG. 13A are led out upward in FIG. 13A, while the anodes 1 and the control electrodes 3A and 3B of the lower emission element array 6A in FIG. 13A are led out downward in FIG. 13A.

Further, the control electrodes 3A and 3B are electrically independent with respect to the individual emission pixels and are separately formed with electric insulation between the control electrodes 3A and 3B. That is, all the control electrodes 3A and 3B are individually drivable by the driving circuit 7. It is therefore possible to not only enable or disable the application of the drive voltages to the control electrodes 3A and 3B individually but also to control the value of the drive voltage for each of the control electrodes 3A and 3B in some case.

Figure 14A:
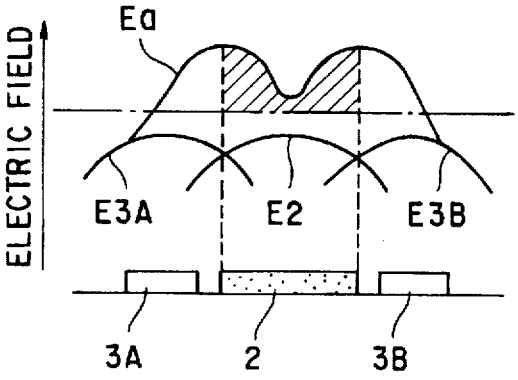
FIGS. 14A and 14B are exemplary diagrams for explaining the operational principle of the optical recording head according to the ninth embodiment.
Figure 14B:
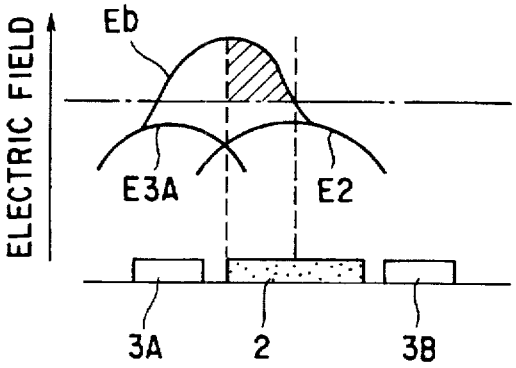

A description will now be given of the relation between the drive states and the light emission state of the anodes 1 and the control electrodes 3A and 3B. FIGS. 14A and 14B are exemplary diagrams showing this relation with respect to one emission pixel in FIGS. 13A to 13C. FIG. 14A shows the normal light emission state, and FIG. 14B the light emission state specific to the present invention.

In FIG. 14A, voltages are applied to the anode 1 and the two control electrodes 3A and 3B arranged around the anode 1 to emit light from the emission pixel formed by the associated phosphor cell 2. If the phosphor cell 2 is given a certain level of conductivity as mentioned above, the potentials of the anode 1 and the phosphor cell 2 can be considered as the same. If the voltages to be applied to the anode 1 and the control electrodes 3A and 3B are so set that the electric field distributions on the phosphor cell 2 and control electrodes 3A and 3B respectively become E2, E3A and E3B as shown in FIG. 14A, the electric field acting on the phosphor cell 2 becomes the electric fields E2, E3A and E3B combined. The combined electric field has a distribution as indicated by Ea in the diagram. Based on the electric field distribution Ea around the phosphor cell 2, the electrons are launched from the cathode 5.

Assuming that the phosphor cell 2 emits light when an electric field stronger than a predetermined electric field strength indicated by an alternate long and short dash line in FIG. 14A, then the electric field in the electric field distribution Ea on the phosphor cell 2, which causes the electrons from the cathode 5 to be launched on the phosphor cell 2 to contribute to light emission is generated in the shaded area in FIG. 14A (the area that covers the entire surface of the phosphor cell 2), and light emission occurs on the entire surface of the phosphor cell 2 as a consequence.

When the anode 1 is not driven or no drive voltage is applied to the anode 1 even if the control electrodes 3A and 3B are both driven, the values of the applied voltages to the anode 1 and control electrodes 3A and 3B are properly set so as to prevent the phosphor cell 2 from emitting light.

In FIG. 14B, unlike in FIG. 14A, the control electrode 3B on the right-hand side in FIG. 14B is not driven, i.e., it is applied with no voltage. In other words, only the anode 1 and the left control electrode 3A are driven. Accordingly, the electric field distribution E3B on the control electrode 3B in FIG. 14A is eliminated, so that the electric field distribution around the phosphor cell 2 becomes the combined electric field of E2 and E3A, which has a distribution as indicated by Eb in FIG. 14B. In this case, the electric field of the electric field distribution Eb on the phosphor cell 2, which contributes to light emission, is generated in the shaded area in FIG. 14B or in the left-hand half of the phosphor cell 2, so that only the left-hand half of the phosphor cell 2 emits light. Likewise, to permit the right-hand half of the phosphor cell 2 to emit light, the control electrode 3A should be disabled while driving the control electrode 3B in FIG. 14B.

According to the optical recording head of the ninth embodiment, as describe above, the control electrode laid out around the phosphor cell 2 is bisected like the control electrodes 3A and 3B in the main scanning direction or in the layout direction of the emission element array 6 (6A, 6B) (the layout direction of the phosphor cells 2), and those control electrodes 3A and 3B are individually driven and controlled so that the partial emission pixel areas obtained by bisecting one emission pixel, formed by one phosphor cell, in the main scanning direction, can selectively be enabled to emit light one by one. Therefore, the phosphor cells 2 can be enabled to emit light at a density double the layout density (a half of the layout pitch of the phosphor cells 2), and high-resolution light emission can be executed in the main scanning direction without actually laying out the phosphor cells 2 at a high density.

Since the light emission pattern of the emission pixels of one pixel formed by one phosphor cell 2 in the optical recording head of the ninth embodiment can be controlled in the main scanning direction, an exposure pattern obtained by exposing only the left-hand side portion or the right-hand side portion of one pixel can be formed on the photosensitive drum as will be described later.

The relation between the drive state of the optical recording head and the obtained light emission pattern will now be discussed with reference to the optical recording head of this invention adapted for an electrophotographic printer.

Figure 15:
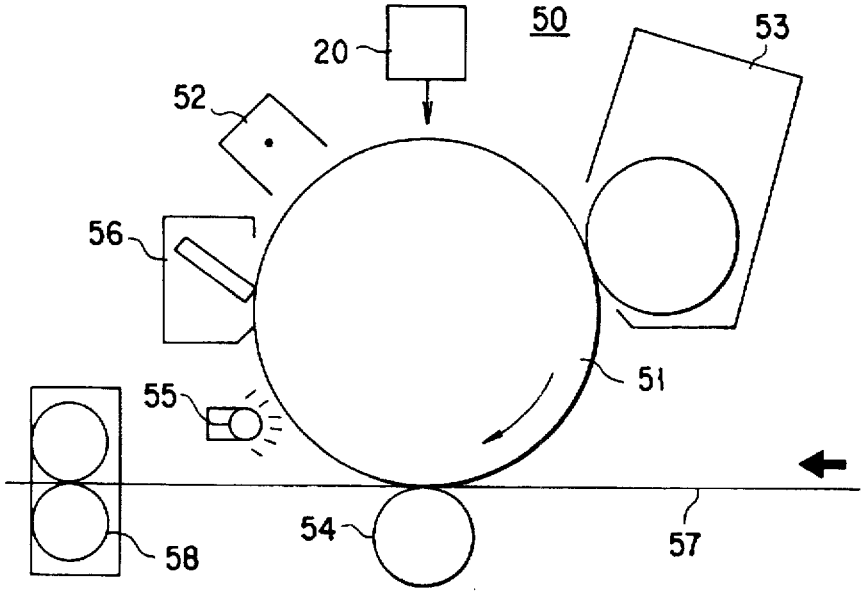
FIG. 15 is a diagram showing the schematic structure of an image recording apparatus embodying this invention.

FIG. 15 illustrates the schematic structure of an image recording apparatus (electrophotographic printer 50). The electrophotographic printer 50 comprises a charger 52, an optical recording head 20, a developer 53, a transfer roller 54, a eraser lamp 55 and a cleaner 56 arranged around a photosensitive drum 51 in the named order. The photosensitive drum 51 rotates clockwise, indicated by the arrow in the diagram, at a constant speed by the driving power transmitted from an unillustrated motor or the like. Since the structures and operations of the individual components except the optical recording head 20 are basically the same as those of the conventional electrophotographic printer, their operations will be briefly discussed below.

Prior to the image formation on recording paper 57, the photosensitive drum 51 starts rotating. As the photosensitive drum 51 rotates, the surface of the photosensitive drum 51 is uniformly charged by the charger 52 first. Next, based on an image signal, the emission pixels in the optical recording head 20 are selected and a partial light emission area in one pixel is further selected to emit light. The light from the optical recording head 20 is irradiated on the charged photosensitive drum 51 via an optical imaging system, such as an unillustrated rod lens array, to expose and scan the surface of the photosensitive drum 51. The structure of the optical recording head 20 is the same as the one shown in FIG. 1.

Through the exposure by the optical recording head 20, the surface potential of the photosensitive drum 51 changes in the portion where light has been irradiated and does not change in the portion where no light has been irradiated, causing a difference in surface potential according to the image signal. In this manner, an electrostatic latent image according to the image signal is formed on the photosensitive drum 51.

Then, the developer 53 causes toners retained inside the developer 53 to stick on the photosensitive drum 51 in accordance with the electrostatic latent image, thus yielding a toner image as a visible image on the photosensitive drum 51.

The recording paper 57 is fed between the transfer roller 54 and the photosensitive drum 51 at the timing controlled by an unillustrated feeding mechanism, so that the toner image, formed on the photosensitive drum 51 by the developer 53, is transferred on the recording paper 57. Thereafter, the recording paper 57 is fed to a fixing unit 58, which is constituted of heat rollers or the like, and the toner image is heated and pressed to be fixed on the recording paper. As a result, the image corresponding to the image signal supplied to the optical recording head 20 is obtained on the recording paper 57.

After the transfer of the toner image on the recording paper 57, the charge on the photosensitive drum 51 is erased by the eraser lamp 55 and the residual toners remaining untransferred on the recording paper 57 are cleaned off by the cleaner 56.

In the thus constituted electrophotographic printer 50, the light irradiation on the photosensitive drum 51 from the optical recording head 20 is executed by selectively driving the individual emission pixels (phosphor cells 2) based on the image signal. The emission element array 6 of the optical recording head 20 is laid out along the lengthwise direction of the photosensitive drum 51 (the depth direction in the figure). With this direction taken as the main scanning direction, the rotational direction of the photosensitive drum 51 corresponds to the sub-scanning direction. With the photosensitive drum 51 rotating at a given speed, when a predetermined phosphor cell 2 of the optical recording head 20 emits light, the light emission pattern on the photosensitive drum 51 is integrated in the sub-scanning direction with respect to time. The exposure area in the sub-scanning direction can therefore be altered by properly controlling the time of the light irradiation on the photosensitive drum 51.

Figure 16A:
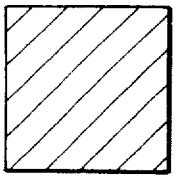
FIGS. 16A to 16K are diagrams showing various exposure patterns obtained by the optical recording head according to the ninth embodiment.
Figure 16B:
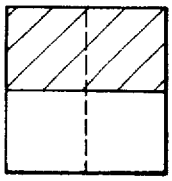
Figure 16C:
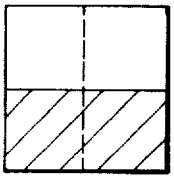

FIGS. 16A to 16K illustrate various exposure patterns formed by the optical recording head 20 of this embodiment. FIG. 16A shows an exposure pattern equivalent6 to the exposure pattern of one pixel by the conventional electrophotographic printer in the case the light irradiation time of the optical recording head 20 is set to the time equivalent to one pixel. FIGS. 16B and 16C show exposure patterns in the case where the exposure start timing is shifted by about a half pixel from the position in FIG. 16A through the control of the light emission timing and the exposure time is controlled to a half of the exposure time in FIG. 16A by controlling the light emission time. As apparent from the above, the area and shape of the exposure pattern can be controlled by controlling the light emission timing (exposure timing) and light emission time (exposure time) of the emission pixels formed by the phosphor cells 2.

FIGS. 17A and 17B are exemplary diagrams for explaining the relation between the exposure time of the emission pixels and the amount of exposure on the photosensitive drum 51. FIG. 17B shows the case where the emission pixels are enabled to emit light by the time corresponding to one pixel to expose the surface of the photosensitive drum 51. FIG. 17A shows the case where the emission pixels are enabled to emit light for exposure by a half the time for the case shown in FIG. 17B. The exposure width in the sub-scanning direction can be altered by the controlling the light emission time of the emission pixels in the above manner.

Figure 16D:
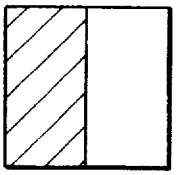
Figure 16E:
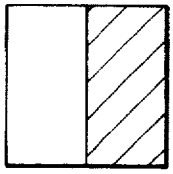
Figure 16F:
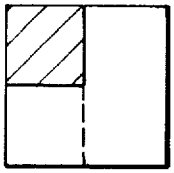
Figure 16G:
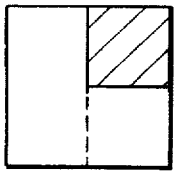
Figure 16H:
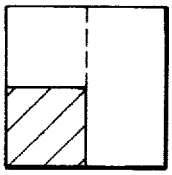
Figure 16I:
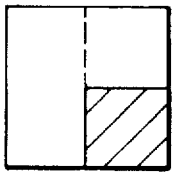
Figure 16J:
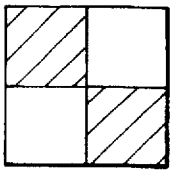
Figure 16K:
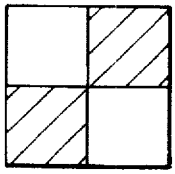

The use of the optical recording head 20 of the ninth embodiment can provide exposure patterns in FIGS. 16D to 16K specific to the present invention in addition to the exposure patterns in FIGS. 16A to 16C. FIGS. 16D and 16E show exposure patterns when almost the left-hand half or right-hand half of one emission pixel shown in FIGS. 13A to 13C is enabled to emit light. In either case, the exposure time is controlled to be equivalent to one pixel in the sub-scanning direction. In FIGS. 16F to 16I, only the left-hand side or right-hand side of one pixel (a half pixel) in the main scanning direction is enabled to emit light, and the light emission start timing corresponding to the sub-scanning direction is shifted forward in FIGS. 16F and 16G or rearward in FIGS. 16H and 16I. In this manner, a pattern to expose a quarter area of one pixel is easily obtained. Further, FIGS. 16J and 16K shows modifications in which the light emission position in the main scanning direction is located on the left-hand side or right-hand side (a half pixel) and is shifted leftward or rightward in the first half or the second half in the sub-scanning direction.

The exposure patterns shown in FIGS. 16A to 16K are to be considered illustrative, and various other exposure areas and exposure patterns may be obtained by controlling the light emission time and light emission timing more finely. For example, an intermediate exposure pattern between those shown in FIGS. 16D and 16F is easily obtained by controlling the light emission time more finely. By properly controlling the drive voltages applied to the control electrodes 3A and 3B, an intermediate exposure pattern between those shown in FIGS. 16A and 16D can easily be obtained even when only the control electrode 3A on the left side of the pixel, for example, is driven. In other words, the exposure pattern in the sub-scanning direction is controlled by changing the exposure time and exposure start timing by controlling the light emission time and light emission timing of the emission pixels, and the exposure pattern in the main scanning direction is controlled by selectively driving the control electrodes 3A and 3B and controlling the drive voltages applied to the control electrodes 3A and 3B.

Therefore, the use of the optical recording head of the ninth embodiment can facilitate the recording of multi-tone images.

FIGS. 18A to 18D show an example of the tone expression in the case where the bisected control electrodes 3A and 3B are provided in association with one emission pixel (phosphor cell 2) as shown in FIGS. 13A to 13C, and are selectively driven to divide each emission pixel into two partial light emission areas in the main scanning direction and divide it into two light emission time areas in the sub-scanning direction, yielding four independent exposure areas on the photosensitive drum 51. In this example, five tones from "0" to "4" can be expressed as shown in FIG. 18A. Patterns different from those used in this example may be obtained. With the use of a 2×2 matrix, any one of the exposure patterns shown in FIGS. 18B to 18D can selectively be used as any of the intermediate tones "1" to "3." In this case, the proper pattern should be selected in consideration of the tone characteristic and the pattern matching with the adjacent pixels.

Figure 19:
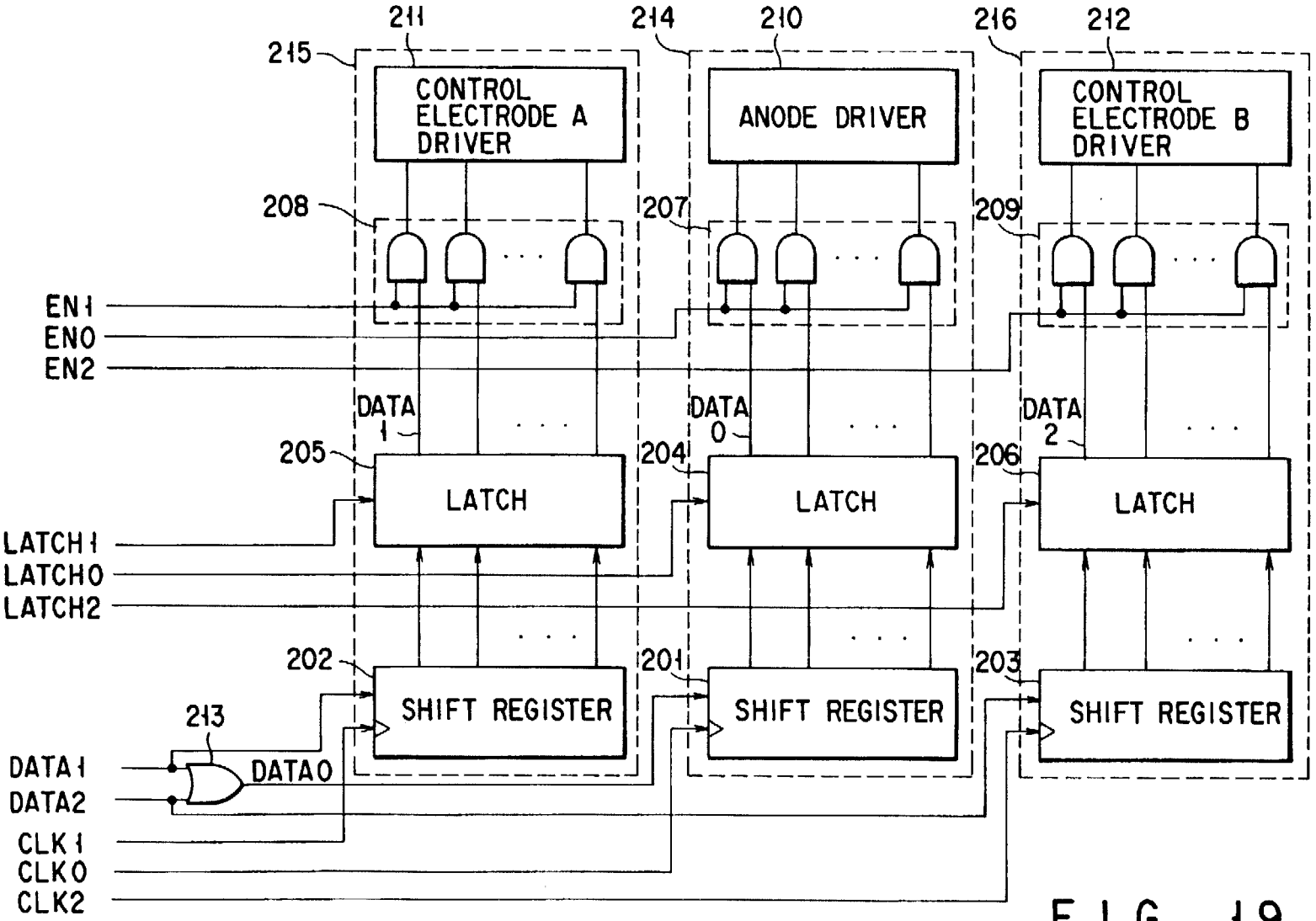
FIG. 19 is a block diagram showing the structure of a driving circuit for the optical recording head of the image recording apparatus according to the eighth embodiment.
Figure 20:
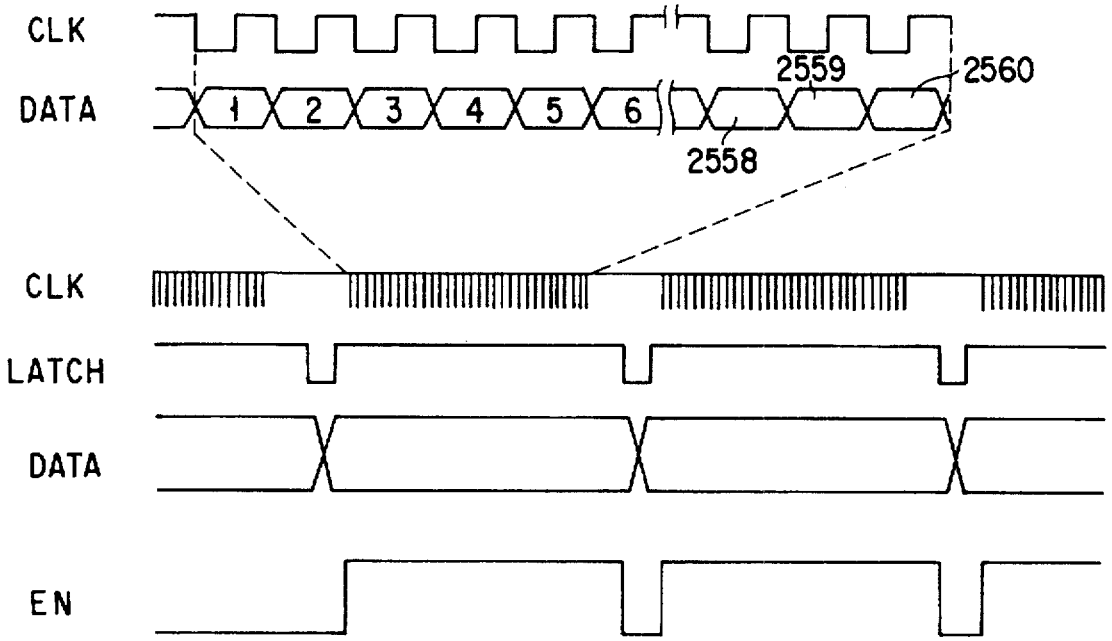
FIG. 20 is a timing chart for explaining the operation of the driving circuit in FIG. 19.

FIG. 19 is a block diagram showing one example of a driving circuit for the optical recording head 20 of the ninth embodiment, and FIG. 20 presents a timing chart illustrating the operation of the driving circuit. This driving circuit comprises shift registers 201, 202 and 203, latch circuits 204, 205 and 206, gate circuits 207, 208 and 209, an anode driver 210, control electrode drivers 211 and 212, and an OR gate 213 for data selection. Those components excluding the OR gate 213 constitute an anode driving section 214 and control electrode driving sections 215 and 216.

The anode driving section 214 selectively drives the anodes 1 shown in FIGS. 13A to 13C based on an image signal. The control electrode driving section 215 selectively drives the control electrode 3A, located on the left side of the phosphor cell 2 shown in FIGS. 13A to 13C, and the control electrode driving section 216 selectively drives the control electrode 3B, located on the right side of the phosphor cell 2. Since anode driving section 214 and the control electrode driving sections 215 and 216 have basically the same structures and basically operate in the same manner, the anode driving section 214 will be described below as a representative.

In FIG. 19, digital anode select data DATA0 consisting of data indicating whether or not the emission pixels (phosphor cells 2) should emit light is input to the shift register 201 at a predetermined transfer speed in response to a clock CLKO. The shift registers 201, 202 and 203 are each constituted by cascade-connecting a plurality of shift register elements (flip-flops). If there are many driving elements in the anode driver 210, a plurality of shift registers should be cascade-connected as needed. In this case, the output of the last stage in each shift register should be input to the first stage in a shift register at the next stage.

It is assumed here that the optical recording head 20 has a total of 2560 emission pixels. When 2560 pieces of anode select data are transferred and input to the shift register 201 from an external device, the data in the shift register 201 is latched by the latch circuit 204 in response to a latch signal LATCH0. The output data "data0" of the latch circuit 204 is held until the next latch signal LATCH comes, so that during this period the next anode select data DATA0 can be transferred to the shift register 201.

When an emission enable signal EN0 is supplied to the gate circuit 207, the output data data0 of the latch circuit 204 is supplied to the anode driver 210 to apply a predetermined voltage to the anodes 1.

Through an operation similar to that of the anode driving section 214, the control electrode driving sections 215 and 216 apply predetermined voltages to the control electrodes 3A and 3B in accordance with light emission data DATA1 and DATA2. The anode driving section 214 selectively drives the anodes in accordance with the anode select data DATA0, whereas the control electrode driving section 215 selectively drive the control electrodes 3A in accordance with the light emission data DATA1 and the control electrode driving section 216 selectively drive the control electrodes 3B in accordance with the light emission data DATA2.

The light emission data DATA1 and DATA2 are supplied as a set of data from an external device, e.g., a tone control section which will be discussed later, and the anode select data DATA0 is produced from those light emission data DATA1 an d DATA2 by the OR gate 213. The relationship among the light emission data DATA1 and DATA2 and the anode select data DATA0 is given in the following table 1.

TABLE 1

| DATA1 | DATA2 | DATA0 | Light Emission Status |
|---|---|---|---|
| 0 | 0 | 0 | no light emission |
| 1 | 0 | 1 | emission on control electrode 3A side |
| 0 | 1 | 1 | emission on control electrode 3B side |
| 1 | 1 | 1 | all emitting light |

When the light emission data DATA1 and DATA2 are neither selected, the output of the anode select data DATA0 also becomes "0" and the anodes 1 are not selectively driven, so that no light is emitted. When either the light emission data DATA1 or DATA2 is selected, the output of the anode select data DATA0 becomes "1" and the anodes 1 are selectively driven, so that the phosphor cell 2 on the control electrode 3A side or the control electrode 3B side corresponding to the selected light emission data DATA1 or DATA2 emits light. When the light emission data DATA1 and DATA2 are both selected, the output of the anode select data DATA0 also becomes "1" and the anodes 1 and both control electrodes 3A and 3B are driven, so that the phosphor cell 2 in one pixel entirely emits light.

As the data selecting OR gate 213 is incorporated in the head driving circuit as described above, the light emission of the phosphor cells 2 can be controlled by preparing only two light emission data DATA1 and DATA2 as an externally input image signal. This structure can reduce the number of data lines and is suitable for fast data transfer.

Figure 21A:
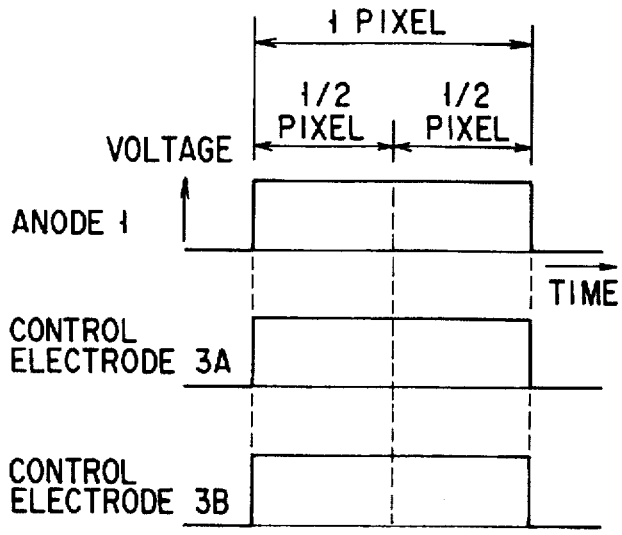
FIGS. 21A to 21F are diagrams for explaining the driving control of the anodes and control electrodes of the optical recording head according to the ninth embodiment.

The drive timings of the anodes 1 and the control electrodes 3A and 3B will now be discussed with reference to FIGS. 21A to 21F. FIG. 21A shows the case where the entire area of the phosphor cell 2 of one emission pixel is enabled to emit light. The period of the emission enable signal EN0 that drives the anodes 1 corresponds to the light emission time. In accordance with this time, the drive timings and driving times of the control electrodes 3A and 3B are controlled and emission enable signals EN1 and EN2 are set.

The voltages applied to the anodes 1 and the control electrodes 3A and 3B are set in such a manner that when at least one of the control electrodes 3A and 3B is selected in addition to the selection of an anode 1, the associated phosphor cell 2 emits light. Therefore, the timings for starting and ending the light emission of the phosphor cell 2 or the light emission time depends on the logical product of the driving times of the anodes 1 and the control electrodes 3A and 3B. To strictly set the light emission timing, therefore, the timings for starting and ending the driving of the anode 1 are strictly set, and the timings should be controlled so that the drive start timing of the control electrode 3A or 3B comes before the start of the driving of the anode 1 and the drive end timing of the control electrode 3A or 3B comes slightly after the end of the driving of the anode 1.

Figure 21B:
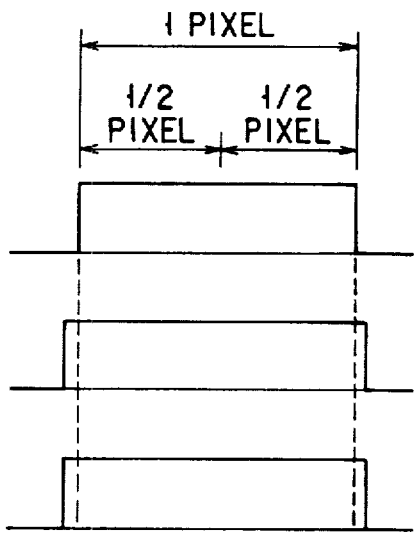

FIG. 21B shows an example in which the drive timings of the anodes 1 and the control electrodes 3A and 3B are set in the above manner. This example can minimize the influences of a variation in the rising delay or falling delay of the drive pulse caused by a productional variation in driving elements in the driver, as compared with the example of FIG. 21A.

Figure 21C:
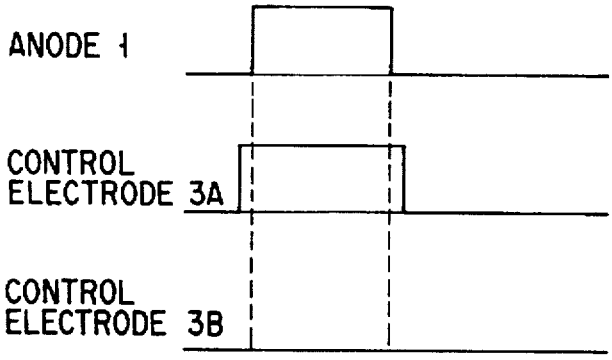
Figure 21D:
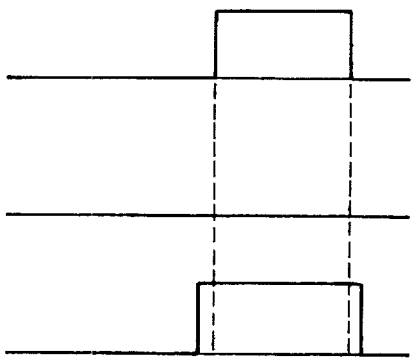

FIGS. 21C and 21D show examples in which one of the control electrodes 3A and 3B is driven by a half pixel in the sub-scanning direction and only the left or right partial light emission area of the emission pixel of the phosphor cell 2 in the main scanning direction is enabled to emit light by a half pixel in the sub-scanning direction. In this manner, the exposure patterns shown in FIGS. 16F and 16I can be obtained. In this case, the driving time of the control electrode 3A or 3B, i.e., the emission enable signal EN1 or EN2 is set wider than the driving time of the anode 1, i.e., the emission enable signal EN0.

Figure 21E:
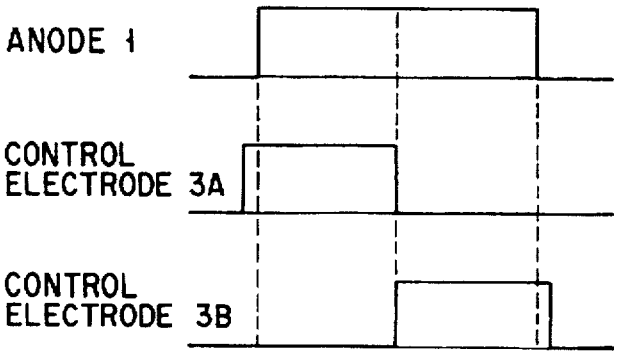
Figure 21F:
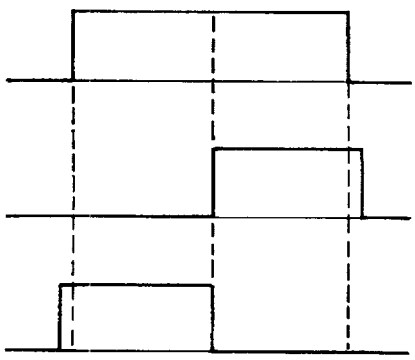

FIGS. 21E and 21F show drive timings for sequentially driving the control electrodes 3A and 3B each by a half portion in the main scanning direction and sequentially driving them by a half pixel in the sub-scanning direction. The illustrated examples correspond to the cases of obtaining the exposure patterns shown in FIGS. 16J and 16K. In this case, since the driving of the control electrodes 3A and 3B is switched in a halfway of one pixel, the anode 1 is driven by one pixel in the sub-scanning direction and the emission enable signals EN1 and EN2 are set so that the driving of the control electrodes 3A and 3B is switched accurately at the timing corresponding to the width of a half pixel in the sub-scanning direction.

Figure 22:
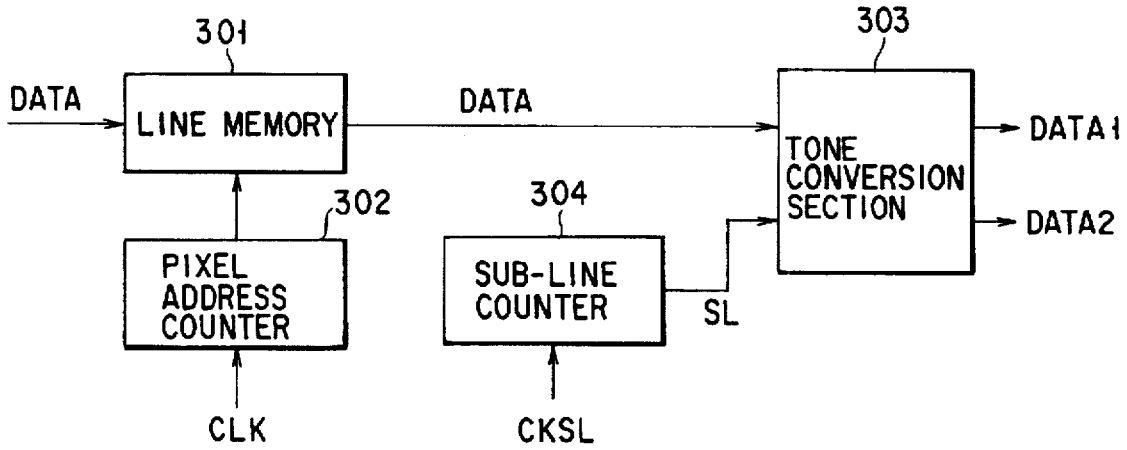
FIG. 22 is a block diagram showing the structure of a tone control section in the image recording apparatus according to the ninth embodiment.
Figure 23:
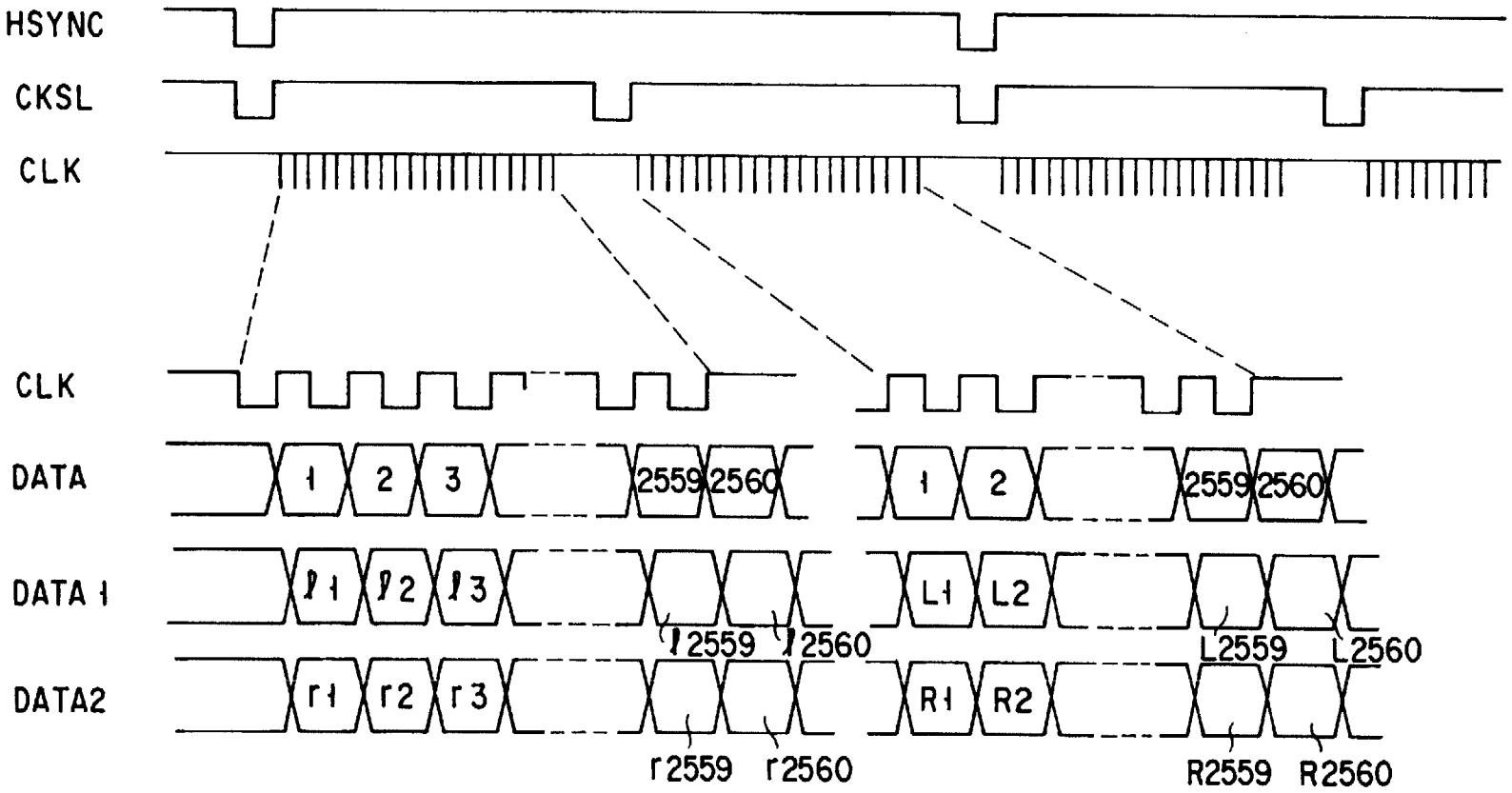
FIG. 23 is a timing chart for explaining the operation of the tone control section in FIG. 22.

FIG. 22 is a block diagram showing the schematic structure of the tone control section in the electrophotographic printer of the present invention, and FIG. 23 presents a timing chart illustrating the operation of the tone control section.

The tone control section causes the optical recording head 20 to form an exposure pattern on the photosensitive drum 51 based on tone image data. The output of an unillustrated scanner or memory, or tone image data DATA consisting of 3-bit digital data per pixel is input to the tone control section via a transfer path. The outputs of the tone control section are the light emission data DATA1 and DATA2 to the optical-recording head driving circuit shown in FIG. 19.

FIGS. 24A and 24B are diagrams showing the correlation between the pixel layout of the tone image data DATA on the photosensitive drum 51 and the partial areas of the exposure pattern.

In the tone control section in FIG. 22, the tone image data DATA is input to a line memory 301 in synchronism with a predetermined clock.

The line memory 301 stores 2560 pieces of tone image data corresponding to one line in the main scanning direction. The tone image data DATA stored in the line memory 301 are sequentially read out by a pixel address counter 302 in synchronism with a transfer clock CLK, and are input to a tone conversion section 303 constituted of a ROM or RAM.

Information (recorded position information) SL indicating whether the current data, input as tone image data DATA, is the first half or second half of one line is also input to the tone conversion section 303 from a sub-line counter 304 which counts a sub-line clock CKSL, which bisects the recording time for one line. The tone conversion section 303 converts the tone image data DATA into data indicating whether or not the partial areas of each emission pixel of the optical recording head 20 should be enabled to emit light in consideration of the recording position. The tone conversion section 303 have two output signals each consisting of one bit indicating whether or not the partial light emission areas of each phosphor cell 2 of the optical recording head 20, bisected in the main scanning direction, should be driven. Those two output signals are input to the optical-recording head driving circuit in FIG. 19 as the light emission data DATA1 and DATA2 for driving the control electrodes 3A and 3B.

The tone conversion section 303 stores a reference table for determining the light emission data DATA1 and DATA2 for driving the emission pixels from the tone image data DATA representing the number of tones per pixel and the recorded position data SL. FIG. 25A shows one example of the reference table in which the tone levels to be expressed are processed based on the threshold values corresponding to the respective areas in a 2×2 threshold matrix shown in FIG. 25B.

The tone image data DATA stored in the line memory 301 is read out twice during one-line recording. More specifically, the first half area of one line in the sub-scanning direction is exposed by the first reading operation, and the second half area in the sub-scanning direction is exposed by the second reading operation.

Five tones from "0" to "4" per emission pixel can be expressed by so-called area toning which alters the area for exposing one pixel in the above manner. More tones can be expressed by dividing the light emission time area in the sub-scanning direction more finely.

Figure 26:
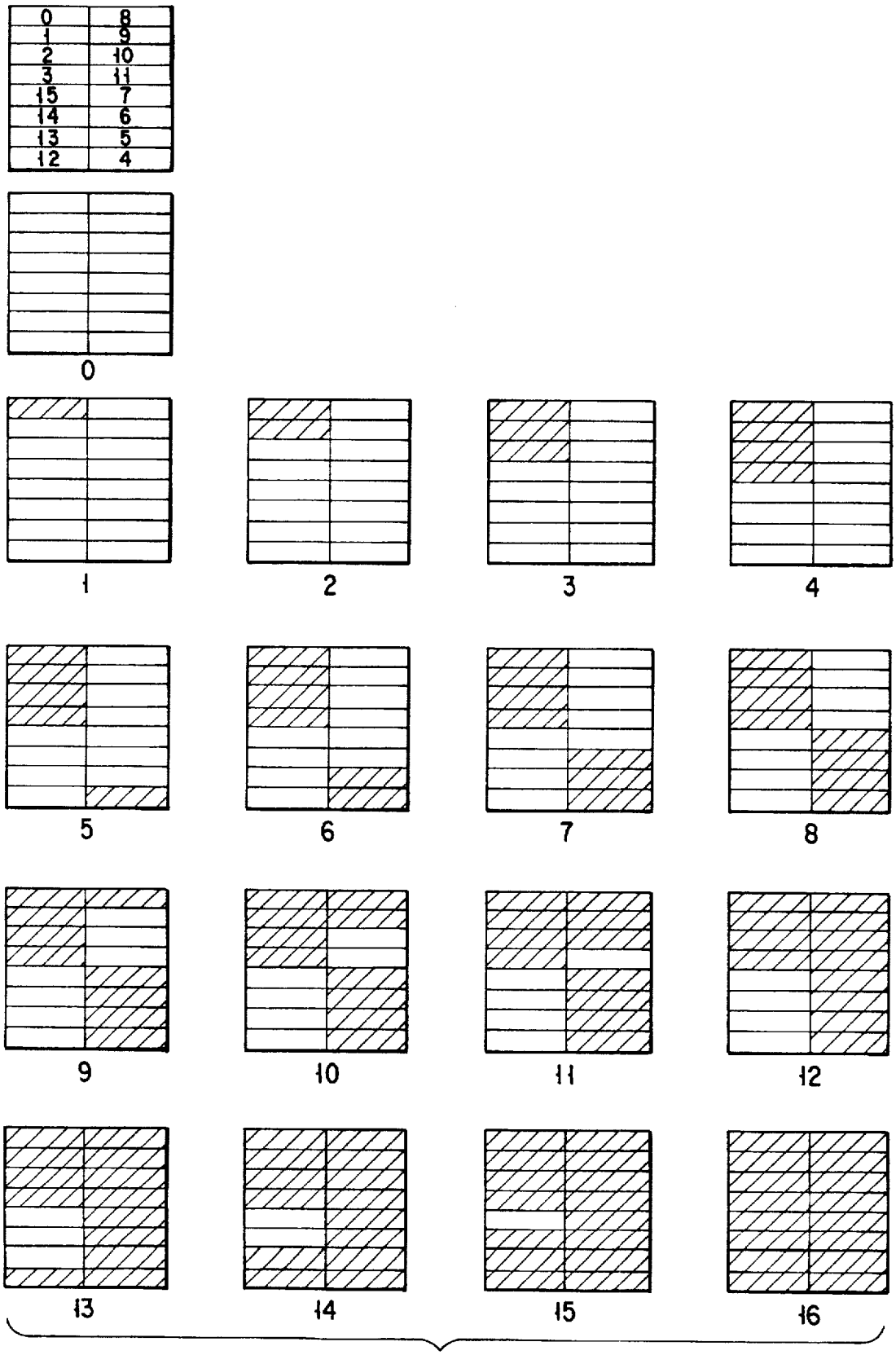
FIG. 26 is a diagram showing an exposure pattern for expressing 17 tones by the image recording apparatus according to the ninth embodiment.

FIG. 26 shows an example where the light emission time area is divided into eight parts in the sub-scanning direction and 17 tones from "0" to "16" can be expressed by those eight divided time areas and the partial light emission areas obtained by bisecting the emission pixel (phosphor cell 2) in the main scanning direction. In this case, the tone control section shown in FIG. 22 controls the tones in the same manner as done in the previous case of bisecting the light emission time area, by using the sub-line clock CKSL for dividing the light emission time area of one line and properly changing the reference table stored in the tone conversion section 303.

In the ninth embodiment, since the emission pixels of the optical recording head 20 are arranged in staggered manner as shown in FIGS. 13A to 13C, the data should be input to even-numbered rows of emission pixels and odd-numbered rows of emission pixels separately and the emission pixels should be driven in consideration of the drive start timings for the even-numbered rows of emission pixels and odd-numbered rows of emission pixels. For the sake of descriptive simplicity, however, the separate data transfers, etc. are omitted.

According to the ninth embodiment, the partial light emission areas obtained by bisecting the emission pixels, formed by the phosphor cells 2 or the like, in the main scanning direction are selected in accordance with the tone level to be expressed, so that image recording with excellent tone expression can be accomplished without lowering the resolution.

Further, richer tone expression is possible by dividing the sub-scanning time for one line and assigning the divided times for light emission in accordance with the tone level to be expressed.

According to the present invention, the size, shape and layout density of the emission pixels are not particularly limited, and the number of partial light emission areas obtained by dividing each emission pixel and their shape and size are also not particularly restrictive. The image recording apparatus embodying this invention is characterized in that the emission pixel of one pixel is divided into a plurality of partial light emission areas in at least the main scanning direction (the layout direction of the emission pixels) and those partial light emission areas are selectively enabled to emit light in accordance with the tone image data to thereby increase the number of expressible tones for each pixel. According to this invention, therefore, the phosphor cell for forming each emission pixel may or may not be separated physically in association with the partial light emission areas. In particular, the separation of each phosphor cell in association with a plurality of partial light emission areas involves highly-accurate coating technology and layout technology, complicating the overall steps and increasing the cost. One can therefore take the advantages of the present invention if the each phosphor cell is not separated as described in the foregoing description of the ninth embodiment.

Figure 27:
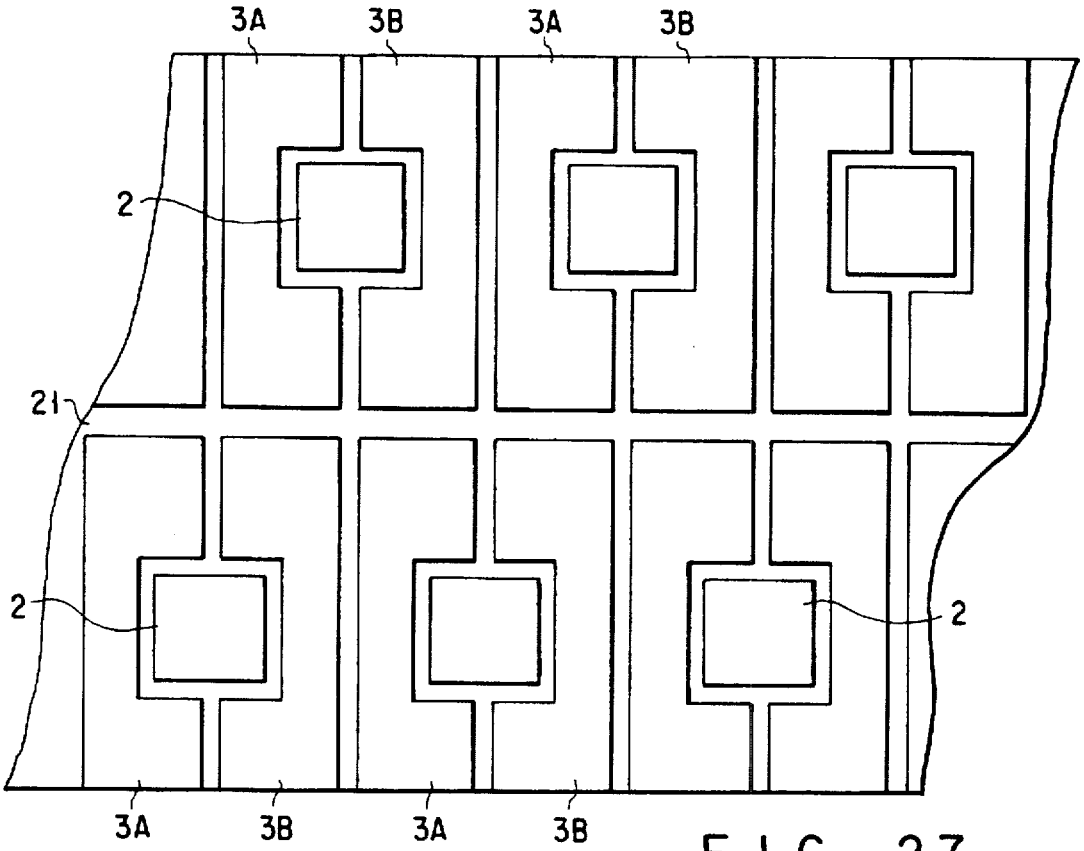
FIG. 27 is a plan view showing the schematic structure of an emission element array of an optical recording head according to a tenth embodiment.
Figure 28A:
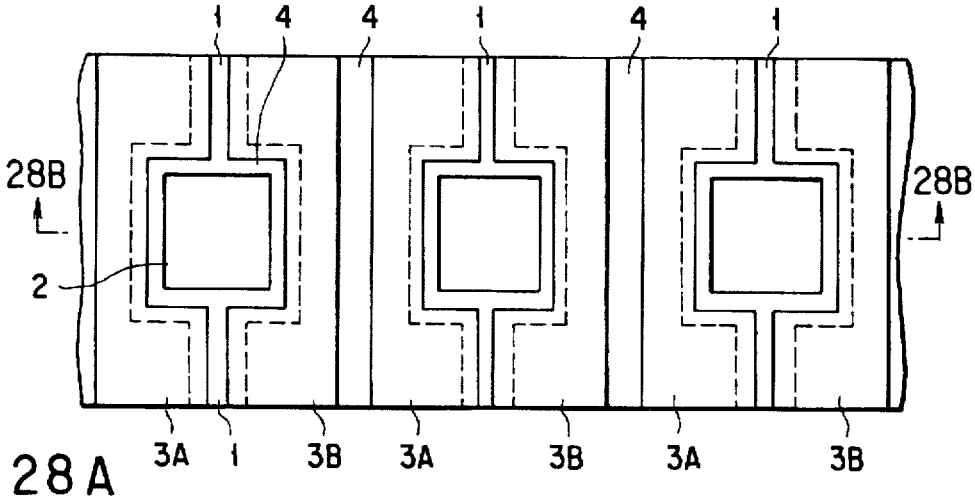
FIGS. 28A and 28B are a plan view and a cross-sectional view showing the structure of the emission element array in FIG. 27 in more detail.
Figure 28B:
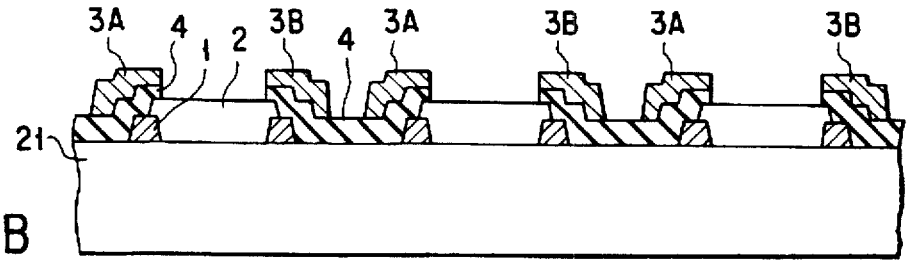

FIG. 27 is a partial enlarged view of the emission element array 6 of an optical recording head according to a tenth embodiment of this invention, and the anodes 1 are not shown in this diagram. FIGS. 28A and 28B show the detailed structure of the emission element array in FIG. 27 including the anodes; FIG. 28B is a cross-sectional view along 28B—28B in FIG. 28A.

Anodes 1 formed on a transparent insulative substrate 21 are laid out to encircle the emission pixels, formed by phosphor cells 2, in a rectangular shape as indicated by the broken lines in FIG. 28A. That is, the shape and size of the emission pixels are defined by the window-like openings of the anodes 1, not by the shape and size of the phosphor cells 2. The phosphor cells 2 having a conductivity are so formed as to partially contact the anodes 1. Even if the phosphor cells 2 are formed to overlap the anodes 1, when the light from the phosphor cells 2 that has passed through the transparent insulative substrate 21 downward in FIG. 28B is used, there is not much influence of the light on the exposure pattern and the coating of the phosphor cells 2 becomes easier.

After the phosphor cells 2 are formed, the insulation layer 4 is deposited. The insulation layer 4 is made of $SiO_2$, polyimide or the like, and is formed up to the edge portions of the anodes 1 and the phosphor cells 2. The size of the emission pixels can be defined by the insulation layer 4 by depositing this insulation layer 4 to the same degree as the size of the emission pixels as much as possible. When the insulation layer 4 is formed to define the size of the emission pixels as mentioned above, the light from the phosphor cells 2 which is guided upward in FIG. 28B as well as the light from the phosphor cells 2 which has passed through the transparent substrate 21 downward can be used. In this case, the anodes 1 can be laid out with substantially the same shape and area as the phosphor cells 2 and the phosphor cells 2 need not have a conductivity. The insulation layer 4 can be formed in a wide area, excluding the emission pixel areas.

The control electrodes 3A and 3B are electrically independently formed on the insulation layer 4. That is, the insulation layer 4 serves to keep the control electrodes 3A and 3B insulated from the anodes 1. The provision of the insulation layer 4 on the anodes 1 allows the control electrodes 3A and 3B to be formed very close to the emission pixels and can widen the areas where the control electrodes 3A and 3B can be formed. When the areas of forming the control electrodes 3A and 3B are widened as mentioned above, it is easy to stably control the launching of the electrons from the cathode. As compared with the case where the control electrodes 3A and 3B are formed on the substrate 21 next to the anodes 1 without forming the insulation layer 4, wider areas can be secured for the control electrodes 3A and 3B, so that the launching of the electrons from the cathode can be controlled stably.

The optical recording head with the above structure is driven in the same manner as done in the ninth embodiment.

In other words, the optical-recording head driving circuit and the drive timing in the tenth embodiment may be those shown in FIGS. 19 and 20, and various exposure patterns as shown in FIGS. 16A to 16K are obtainable. The optical recording head of the tenth embodiment is advantageous over the ninth embodiment shown in FIGS. 13A to 13C in that the phosphor cells 2 are formed easily, the emission pixel areas are easily defined and the control electrodes 3A and 3B are formed widely. Those advantages can ensure stable light emission control with fewer variations.

Figure 29:
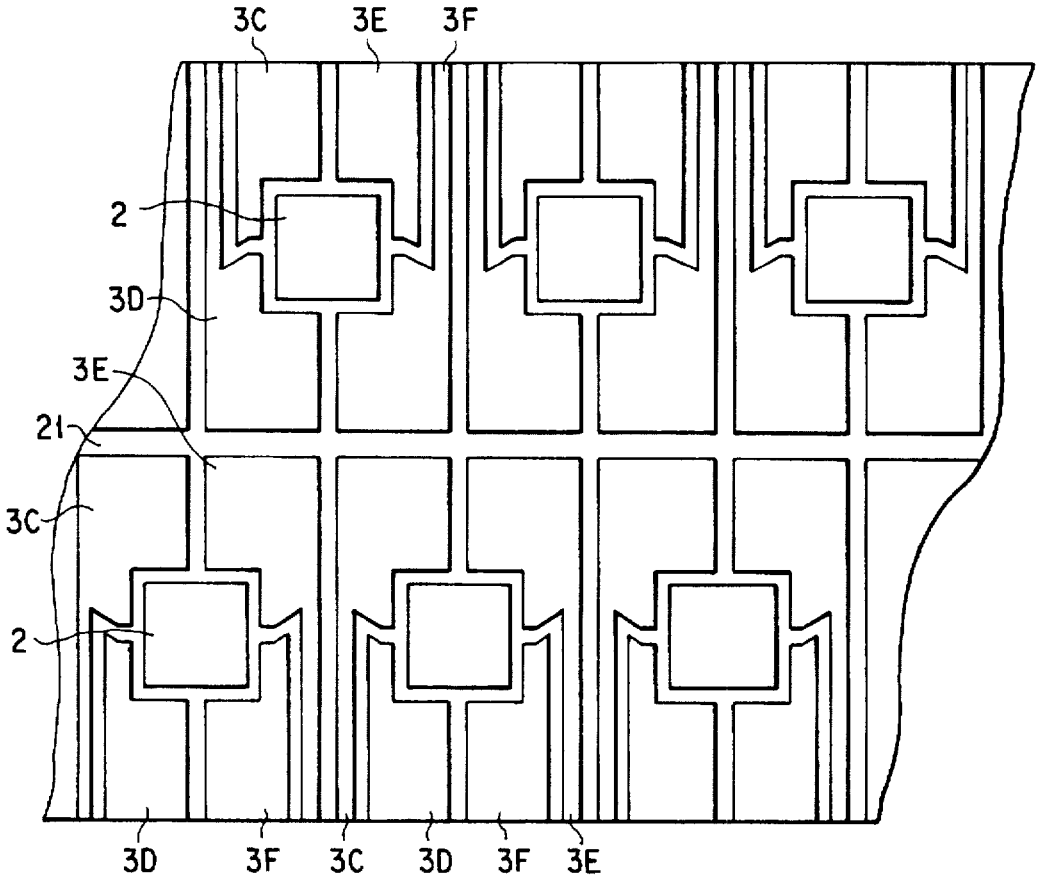
FIG. 29 is a plan view showing the schematic structure of an emission element array of an optical recording head according to an eleventh embodiment.

FIG. 29 is a partial enlarged view of the emission element array 6 of an optical recording head according to an eleventh embodiment of this invention, and the anodes 1 are not shown in this diagram. While the control electrodes 3A and 3B bisected per pixel are laid out in the ninth and tenth embodiments, quadrisected control electrodes 3C, 3D, 3E and 3F per pixel are arranged as one set around the associated emission pixel in the eleventh embodiment. In other words, the control electrode associated with each emission pixel is bisected in the main scanning direction (layout direction of the emission pixel) and is also bisected in the sub-scanning direction. Those control electrodes 3C, 3D, 3E and 3F can be formed using a single mask pattern as per the ninth and tenth embodiments. One end of the anodes 1, the control electrodes 3C, 3D, 3E and 3F are led out by lead lines or the like to be connected to an unillustrated driving IC.

The optical recording head of the eleventh embodiment is driven by selecting the partial emission pixel areas in one pixel which should be enabled to emit light, individually driving the control electrodes 3C, 3D, 3E and 3F and selecting the associated anode 1. For example, to emit light from the upper left, quarter partial emission pixel area of one pixel of the phosphor cell 2, the associated anode 1 and the control electrode 3C are selected. In this case, the exposure pattern shown in FIG. 16F can be attained without considering the exposure time in the sub-scanning direction. If the anode 1 and the control electrodes 3C and 3D are selectively driven at the same time, an exposure pattern equivalent to the exposure pattern shown in FIG. 16D can be obtained without considering the exposure time in the sub-scanning direction.

According to the optical recording head of the eleventh embodiment, as discussed above, the control electrode is bisected in both the main scanning direction and the sub-scanning direction, yielding quadrisected control electrodes as a whole, so that this optical recording head can accomplish finer light emission control than the optical recording heads of the previous embodiments without considering the exposure time in the sub-scanning direction.

It is desirable that the control electrodes 3C, 3D, 3E and 3F should be formed in the same shape and same area as much as possible and are arranged to be symmetrical to the associated emission pixel (phosphor cell 2) in the eleventh embodiment. If those conditions cannot be met due to the connection of the optical recording head to the driving IC as mentioned above, however, the shape and layout areas of the control electrodes should be set in consideration of the influence of an electric field on the phosphor cells 2. In view of the above, the control electrodes 3C and 3E are laid out symmetrical to each other while the control electrodes 3D and 3F are laid out symmetrical to each other, and the shapes and areas of the control electrodes 3C and 3E slightly differ from those of the control electrodes 3D and 3F in the eleventh embodiment. With this design, when the individual control electrodes 3C, 3D, 3E and 3F are selected, those control electrodes provide nearly the same electric field to the associated emission pixel.

The values of the voltages applied to the control electrodes 3C, 3D, 3E and 3F and the times for applying those voltages may be separately set with respect to the individual control electrode to make the influence of the electric field on the emission pixel nearly even. In the eleventh embodiment, this control becomes simpler because it is easy to set the shapes and layout areas of the control electrodes 3C, 3D, 3E and 3F in the eleventh embodiment.

As apparent from the above, the optical recording heads according to the ninth to eleventh embodiments are designed to layout the control electrodes in such a way that the partial emission pixel areas of each emission pixel are selectively enabled to emit light, regardless of the shapes and layout areas of the control electrodes and the number of the control electrodes.

The ninth to eleventh embodiments are not limited to the optical recording heads which have the phosphor cells and anodes formed on the same substrate. For example, this invention may be adapted for an optical recording head which has the control electrode laid out in the space between the phosphor cells and anodes on the substrate and the overlying filament cathode, as disclosed in Jap. Pat. Appln. KOKOKU Publication No. 3-22021.

Figure 30:
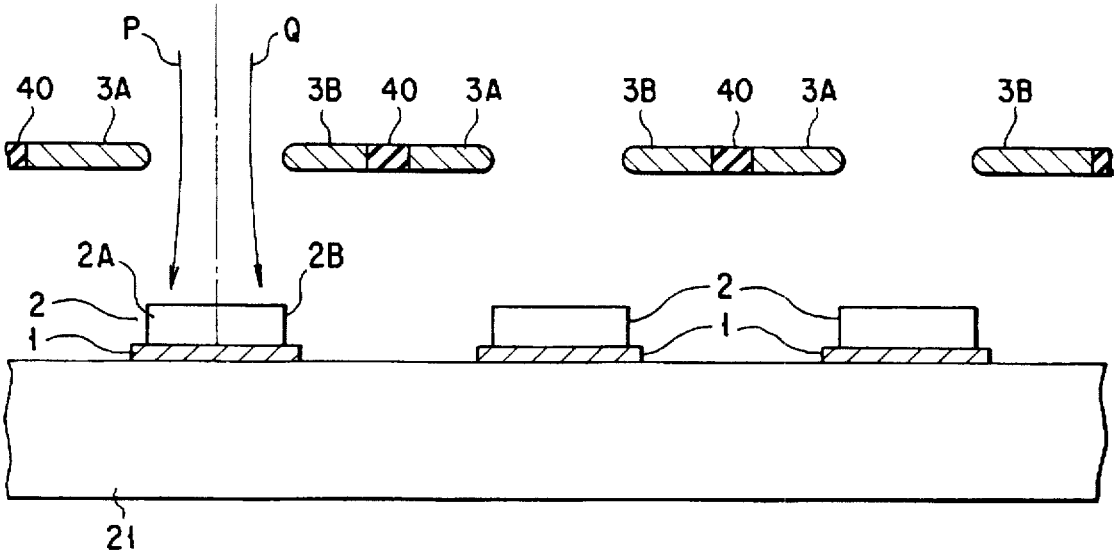
FIG. 30 is a cross-sectional view showing the schematic structure of an emission element array of an optical recording head according to a twelfth embodiment.

FIG. 30 is a cross-sectional view showing the structure of an optical recording head according to a twelfth embodiment of this invention. Phosphor cells are deposited on the anodes 1 formed on a substrate 21, with control electrodes 3A and 3B laid above and apart from the phosphor cells 2. An unillustrated filament cathode is laid out above the control electrodes 3A and 3B. The electrons emitted from the cathode are accelerated by electric fields applied by the control electrodes 3A and 3B, and are launched toward the phosphor cells 2 as indicated by arrows P and Q by an electric field applied to the anodes 1, thereby causing the phosphor cells 2 to emit light.

The eleventh embodiment significantly differs from the head structure disclosed in Jap. Pat. Appln. KOKOKU Publication No. 3-22021 in that the control electrodes 3A and 3B are electrically insulated by an insulating member 40 from the phosphor cells 2 associated with the emission pixels, and those control electrodes 3A and 3B are connected to an unillustrated driving circuit so as to be independently and individually driven. According to the eleventh embodiment, when only one of the control electrodes 3A and 3B, e.g., the control electrode 3A, is driven, the accelerating electric field is formed by the control electrode 3A so that most of the electrons from the cathode are launched along the locus indicated by the arrow P, shifted toward the control electrode 3A from the control electrode 3B. Accordingly, the partial light emission area 2A on the control electrode 3A side of the phosphor cell 2 emits light more intensely than the partial light emission area 2B on the control electrode 3B side. It is therefore possible to selectively enable the partial light emission areas of one emission pixel as per the ninth to eleventh embodiments. It is needless to say that the structure of the optical recording head of the eleventh embodiment can be adapted for the case where the control electrode is quadrisected.

The present invention is not limited to the above-described embodiments.

For instance, while the foregoing descriptions of the embodiments have been given with reference to the case where two rows of emission element arrays are arranged in staggered fashion, more than two rows of emission element arrays may be arranged, or one row of an emission element array may be laid out without the staggered arrangement.

The method of utilizing the light emitted from the phosphor cells in the optical recording head embodying the present invention is not particularly limited. For example, this invention is not limited to the case where the light that has passed the substrate 21 on which the emission element array 6 is formed is utilized as shown in FIG. 1, but the substrate 21 of an opaque material may be provided with the transparent cover glass 23 placed thereabove so that the light from the phosphor cells which has passed the cover glass 23 upward can be utilized. In this case, the imaging system should be provided on the side of the cover glass 23.

Further, the optical recording head used in the image recording apparatus according to this invention is not limited to the one which utilizes the light emitted from the phosphor cells. The optical recording head may have emission pixels formed by other solid light emission elements, such as LEDs (Light Emitting Diodes) or EL (Electroluminescence) elements as long as each emission pixel is divided into a plurality of partial light emission areas at least in the layout direction (main scanning direction) and those partial light emission areas are selectively driven.

What is claimed is:

1. An optical recording head comprising:

a cathode for emitting electrons; and an emission element array, provided apart from said cathode, wherein said emission element array comprises a substrate, a plurality of anodes arranged at predetermined intervals on said substrate, a plurality of phosphor cells, arranged in contact to said anodes on said substrate, for emitting light based on said electrons from said cathode, at least one control electrode laid out on said plurality of phosphor cells for accelerating said electrons emitted from said cathode, and an insulation layer provided between said anodes and said control electrode, said control electrode being laid out on said insulation layer to partially overlap said anodes.

2. The optical recording head according to claim 1, wherein said control electrode is laid out to surround each of said phosphor cells.

3. The optical recording head according to claim 1, wherein said anodes each have a rectangular opening to set a radiation plane of light emitted from said phosphor cells to a predetermined shape.

4. The optical recording head according to claim 2, wherein said insulation layer has an opening to set an incident plane of said electrons to said phosphor cells to a predetermined shape.

5. The optical recording head according to claim 2, further comprising a second insulation layer provided on said insulation layer between adjacent phosphor cells, whereby said control electrode between adjacent phosphor cells is higher than said control electrode in other areas.

6. The optical recording head according to claim 1, further comprising an electrode formed on said control electrode between adjacent phosphor cells.

7. The optical recording head according to claim 1, wherein said control electrode includes:

a first control electrode to which a first voltage for forming a predetermined electric field is applied; and a second control electrode provided between adjacent phosphor cells and formed on an insulation layer.

8. The optical recording head according to claim 1, further comprising means for applying a voltage higher than said first voltage to said second control electrode.

9. The optical recording head according to claim 1, wherein said control electrode includes a plurality of control electrodes each laid out to surround an associated one of said phosphor cells.

10. An optical recording head comprising:

a cathode for emitting electrons; and an emission element array, provided apart from said cathode, wherein said emission element array comprises a substrate, a plurality of anodes arranged at predetermined intervals on said substrate, a plurality of phosphor cells, arranged in contact to said anodes on said substrate, for emitting light based on said electrons from said cathode, an insulation layer formed on said substrate, a first control electrode, provided on said insulation layer and being electrically insulated from said anodes, for accelerating said electrons emitted from said cathode, and a second control electrode for setting an electric field between said phosphor cells stronger than an electric field formed by said first control electrode.

11. The optical recording head according to claim 10, further comprising:

means for applying a predetermined first voltage to said first control electrode; and means for applying a second voltage higher than said first voltage to said second control electrode.

12. An optical recording head comprising:

a cathode for emitting electrons;

an emission element array, provided apart from said cathode, wherein said emission element array comprises a substrate, a plurality of anodes arranged at predetermined intervals on said substrate, a plurality of phosphor cells, arranged in contact to said anodes on said substrate, for emitting light based on said electrons from said cathode, and a plurality of control electrodes, arranged around each of said phosphor cells, for accelerating said electrons from said cathode;

anode driving means for independently driving each of said plurality of anodes; and control electrode driving means for independently driving each of said plurality of control electrodes corresponding to each of said plurality of anodes;

wherein said anode driving means includes means for applying a first voltage to said anodes corresponding to phosphor cells to emit light, said first voltage being positive with respect to a voltage applied to said cathode, and said control said first voltage to said control electrodes corresponding to said phosphor cells to emit light; and said control electrode driving means includes means for applying a second voltage to said control electrode corresponding to phosphor cells that are not to emit light, said second voltage being positive with respect to a voltage applied to said cathode, and said anode driving means includes means for applying a voltage equal to or lower than said second voltage to said anodes corresponding to said phosphor cells that are not to emit light.

13. The optical recording head according to claim 12, wherein said control electrode driving means includes means for setting a voltage of said control electrodes corresponding to said phosphor cells that are to emit light to zero, and said anode driving means includes means for setting a voltage of said anodes corresponding to said phosphor cells that are not to emit light to zero.

14. An optical recording head comprising:

a cathode for emitting electrons;

an emission element array, provided apart from said cathode and having a substrate, a plurality of anodes arranged at predetermined intervals on said substrate, and a plurality of phosphor cells, arranged in contact to said anodes on said substrate, for emitting light based on said electrons from said cathode; and a plurality of control electrodes, provided at least two for each of said phosphor cells between said cathode and said emission element array, for accelerating said electrons from said cathode, wherein said control electrodes are laid out so that a plurality of control electrodes associated with each of said plurality of phosphor cells surround said plurality of phosphor cells.

15. The optical recording head according to claim 14, wherein each of said plurality of control electrodes is divided into at least two parts in a layout direction of said plurality of phosphor cells.

16. The optical recording head according to claim 14, further comprising an insulation layer disposed on said anodes, and wherein said control electrodes are laid out on said insulation layer so that each of said control electrodes partially overlaps an associated one of said anodes.

17. The optical recording head according to claim 14, wherein each of said plurality of control electrodes is divided into at least two parts in a direction perpendicular to a layout direction of said phosphor cells.

18. The optical recording head according to claim 14, wherein said plurality of control electrodes are laid out on said substrate.

19. An image recording apparatus comprising:

an optical recording head having a plurality of phosphor cells arranged in one row at least in a predetermined direction and dividing means for dividing each of said phosphor cells into a plurality of partial light emission areas in a layout direction of said phosphor cells; and tone control means for selectively enabling said plurality of partial light emission areas in accordance with tone image data.

20. The image recording apparatus according to claim 19, wherein said tone control means includes means for controlling light emission times of said partial light emission areas.

21. The image recording apparatus according to claim 19, wherein said optical recording head includes:

a cathode for emitting electrons;

an emission element array, provided apart from said cathode, wherein said emission element array comprises a substrate, a plurality of anodes arranged at predetermined intervals on said substrate, and a plurality of phosphor cells, arranged in contact to said anodes on said substrate, for emitting light based on said electrons from said cathode; and a plurality of control electrodes, provided at least two for each of said phosphor cells between said cathode and said emission element array, for accelerating said electrons from said cathode, each of said control electrodes being divided into at least two parts in said layout direction of the phosphor cells.

22. An optical recording head comprising:

a cathode for emitting electrons; and an emission element array, provided apart from said cathode, wherein said emission element comprises a substrate, a plurality of anodes arranged at predetermined intervals on said substrate, a plurality of phosphor cells, arranged in contact to said anodes on said substrate, for emitting light based on said electrons from said cathode, an insulation layer formed on said substrate, a first control electrode, provided on said insulation layer and being electrically insulated from said cathode, and a second control electrode formed over said first control electrode.

23. The optical recording head according to claim 22, further comprising an insulation layer formed between said first and said second control electrode.

24. The optical recording head according to claim 23, further comprising:

means for applying a predetermined first voltage to said first control electrode; and means for applying a second voltage higher than said first voltage to said second control electrode.

* * * * *

UNITED STATES PATENT AND TRADEMARK OFFICE

CERTIFICATE OF CORRECTION

PATENT NO. : 5,754,216
DATED : May 19, 1998
INVENTOR(S) : Kazuhiko HIGUCHI et al.

It is certified that error appears in the above-indentified patent and that said Letters Patent is hereby corrected as shown below:

Claim 12, Col. 28, line 54, after "said control", insert --electrode driving means includes means for applying a voltage equal to or lower than--.

Signed and Sealed this

Twenty-ninth Day of June, 1999

*Attest:*

Q. TODD DICKINSON

*Attesting Officer*

*Acting Commissioner of Patents and Trademarks*